US009780462B2

(12) United States Patent
Nakata et al.

(10) Patent No.: US 9,780,462 B2
(45) Date of Patent: Oct. 3, 2017

(54) CRIMP TERMINAL

(71) Applicants: Yazaki Corporation, Minato-ku, Tokyo (JP); TOYOTA JIDOSHA KABUSHIKI KAISHA, Toyota-shi, Aichi-ken (JP)

(72) Inventors: Hirohito Nakata, Shizuoka (JP); Masaru Fukuda, Shizuoka (JP); Takato Yoshida, Shizuoka (JP); Hiroshi Kobayashi, Okazaki (JP); Hiroyasu Taga, Toyota (JP); Motoya Hara, Nisshin (JP)

(73) Assignees: YAZAKI CORPORATION, Minato-ku, Tokyo (JP); TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 15/378,933

(22) Filed: Dec. 14, 2016

(65) Prior Publication Data

US 2017/0179619 A1 Jun. 22, 2017

(30) Foreign Application Priority Data

Dec. 16, 2015 (JP) ..... 2015-244874

(51) Int. Cl.
*H01R 13/52* (2006.01)
*H01R 4/18* (2006.01)
*H01R 13/11* (2006.01)

(52) U.S. Cl.
CPC ..... *H01R 4/185* (2013.01); *H01R 13/114* (2013.01)

(58) Field of Classification Search
CPC ..... H01R 4/185; H01R 4/188
USPC ..... 439/877
See application file for complete search history.

(56) References Cited

U.S. PATENT DOCUMENTS

2013/0171873 A1* 7/2013 Kanda ..... H01R 13/6581 439/607.51
2014/0033520 A1* 2/2014 Nakagishi ..... H01R 43/048 29/753
2014/0220835 A1 8/2014 Seipel et al.
(Continued)

FOREIGN PATENT DOCUMENTS

JP 2012-69449 A 4/2012
JP 2014-150044 A 8/2014
(Continued)

*Primary Examiner* — Abdullah Riyami
*Assistant Examiner* — Nader Alhawamdeh
(74) *Attorney, Agent, or Firm* — Sughrue Mion, PLLC

(57) ABSTRACT

A crimp terminal includes: a terminal fitting having a terminal connecting portion electrically connected to a counterpart terminal and an electric wire connecting portion electrically connected by crimping to an end portion of an electric wire placed on an inner wall surface thereof; and a second water stop portion that is pasted on the inner wall surface of the electric wire connecting portion before crimping and that, after crimping, forms a second water stop area capable of suppressing water entry between the electric wire connecting portion and the core wire from the terminal connecting portion side with respect to the distal end position of the core wire at the distal end of the electric wire. The electric wire connecting portion has a core wire crimp portion crimped on the core wire at the distal end of the electric wire.

5 Claims, 20 Drawing Sheets

(56) References Cited

U.S. PATENT DOCUMENTS

| | | | | |
|---|---|---|---|---|
| 2014/0317922 | A1* | 10/2014 | Schmidt | H01R 13/422<br>29/863 |
| 2015/0017833 | A1* | 1/2015 | Sato | H01R 4/184<br>439/519 |
| 2015/0357722 | A1* | 12/2015 | Sato | H01R 13/5216<br>439/877 |
| 2016/0006164 | A1* | 1/2016 | Sato | H01R 4/185<br>439/587 |

FOREIGN PATENT DOCUMENTS

| | | | | |
|---|---|---|---|---|
| JP | 2014-160591 | A | 9/2014 | |
| JP | 2014-182958 | A | 9/2014 | |
| JP | WO 2014148380 | A1 * | 9/2014 | H01R 4/185 |
| JP | 2014-182957 | A | 9/2016 | |

* cited by examiner

CRIMP TERMINAL

CROSS-REFERENCE TO RELATED APPLICATION(S)

The present application claims priority to and incorporates by reference the entire contents of Japanese Patent Application No. 2015-244874 filed in Japan on Dec. 16, 2015.

BACKGROUND OF THE INVENTION

1. Field of the Invention

The present invention relates to a crimp terminal.

2. Description of the Related Art

Conventionally, a crimp terminal including an electric wire connecting portion that is electrically connected to a core wire of an electric wire is known. This crimp terminal and the electric wire are crimped by a terminal crimping device to be electrically connected to each other. In the crimp terminal of this type, suppression of water entry between the electric wire connecting portion and the core wire of the electric wire is required. For example, in techniques of Japanese Patent Application Laid-open No. 2014-182957 and Japanese Patent Application Laid-open No. 2014-182958, a water stop portion for sealing a gap between a barrel piece and an electric wire is provided. This water stop portion is formed by pasting a water stop sheet made of butyl rubber, for example, on an inner surface of the barrel piece and swaging the electric wire set on this water stop sheet with the barrel piece. In techniques of Japanese Patent Application Laid-open No. 2014-160591 and Japanese Patent Application Laid-open No. 2012-69449, instead of such a water stop sheet, a layer (insulating coating portion) of insulating resin such as polyethylene or butyl rubber is formed, and this insulating resin layer serves as a water stop portion after swaging of a barrel piece. Another conventional example is described in Japanese Patent Application Laid-open No. 2014-150044.

In such a crimp terminal for which swaging is performed on an electric wire, during the swaging, the electric wire is compressed by a barrel piece to stretch in the axial direction. In the crimp terminal, a water stop sheet or an insulating resin layer is squeezed out in accordance with the stretching of the electric wire, which may deteriorate the waterproof performance in this squeezed area. In drawings illustrated in Japanese Patent Application Laid-open No. 2014-150044, a portion like a track-shaped protruding portion is formed on the tab (terminal connecting portion) side with respect to the distal end of an electric wire. However, this portion does not suppress the water stop sheet or the insulating resin layer from being squeezed out.

SUMMARY OF THE INVENTION

In view of this, it is an object of the present invention to provide a crimp terminal having a high waterproof performance in an electric wire connecting portion.

In order to achieve the above mentioned object, a crimp terminal according to one aspect of the present invention includes a terminal fitting having a terminal connecting portion that is electrically connected to a counterpart terminal and an electric wire connecting portion that is electrically connected by crimping to an end portion of an electric wire placed on an inner wall surface of the electric wire connecting portion; and a water stop member that is pasted on the inner wall surface of the electric wire connecting portion before the crimping is performed and that, after the crimping is completed, forms a water stop area that is capable of suppressing water entry between the electric wire connecting portion and the core wire from the terminal connecting portion side with respect to a distal end position of a core wire at a distal end of the electric wire, wherein the electric wire connecting portion has a core wire crimp portion that is crimped on the core wire at the distal end of the electric wire by winding each of first and second barrel piece portions around the end portion of the electric wire during the crimping, and the inner wall surface of the core wire crimp portion has, on the terminal connecting portion side with respect to the distal end position of the core wire placed, a protruding portion configured to lock the distal end position of the core wire that stretches in an axial direction during the crimping.

According to another aspect of the present invention, in the crimp terminal, it is desirable that the water stop member is pasted on a top surface of the protruding portion, the inner wall surface of the core wire crimp portion has a groove portion into which part of the water stop member pasted is charged between the distal end position of the core wire and the protruding portion, and the water stop member between the top surface of the protruding portion and the groove portion and the water stop member charged into the groove portion serve as a component of the water stop area after the crimping is completed.

According to still another aspect of the present invention, in the crimp terminal, it is desirable that the first barrel piece portion and the second barrel piece portion have an overlap area in which an outer wall surface of either one of these barrel piece portions and the inner wall surface of the other of these barrel piece portions overlap each other, and the protruding portion is arranged in a position apart from the overlap area.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
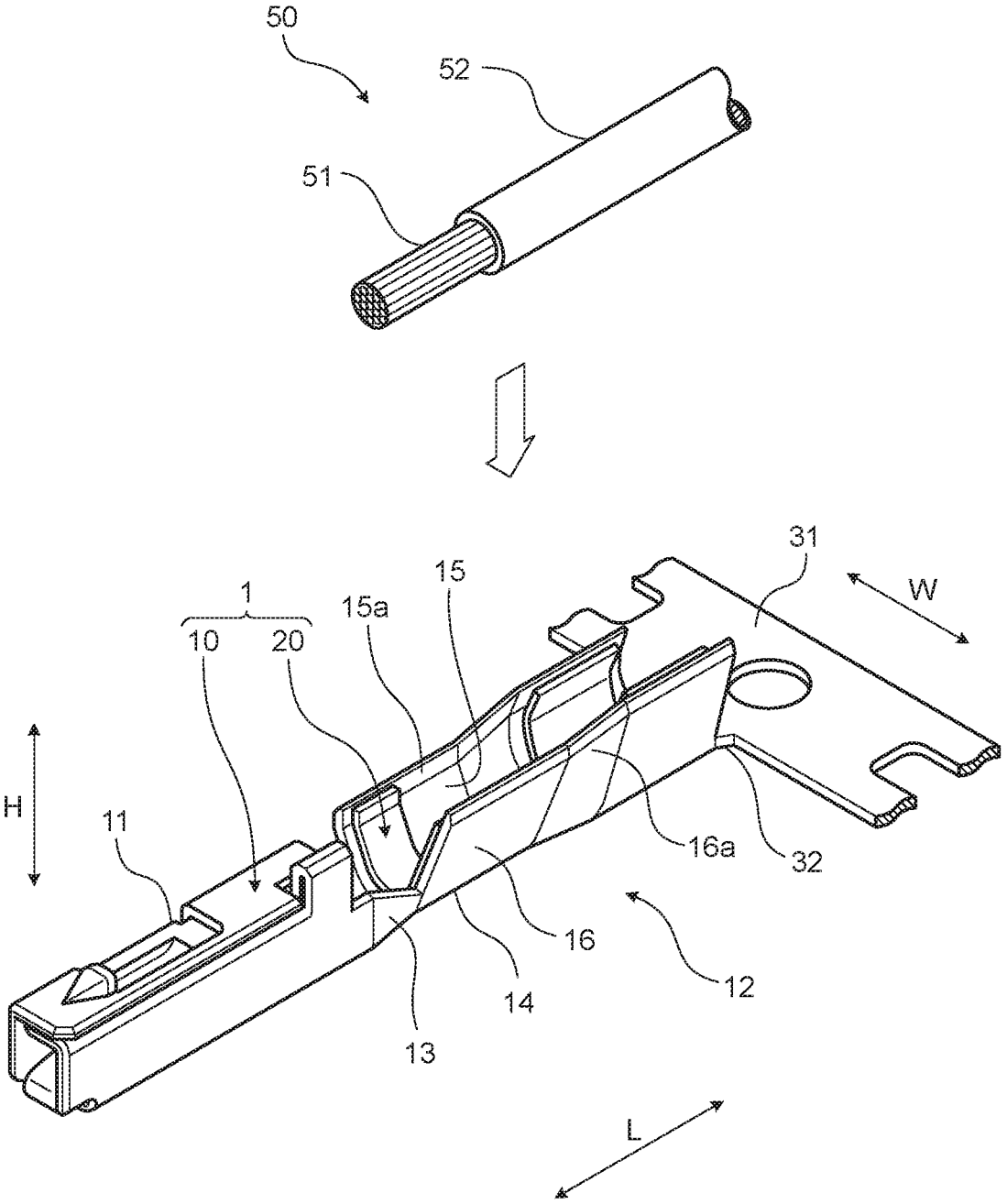
FIG. 1 is a perspective view illustrating a crimp terminal according to an embodiment, depicting a state before being connected to an electric wire.
Figure 2:
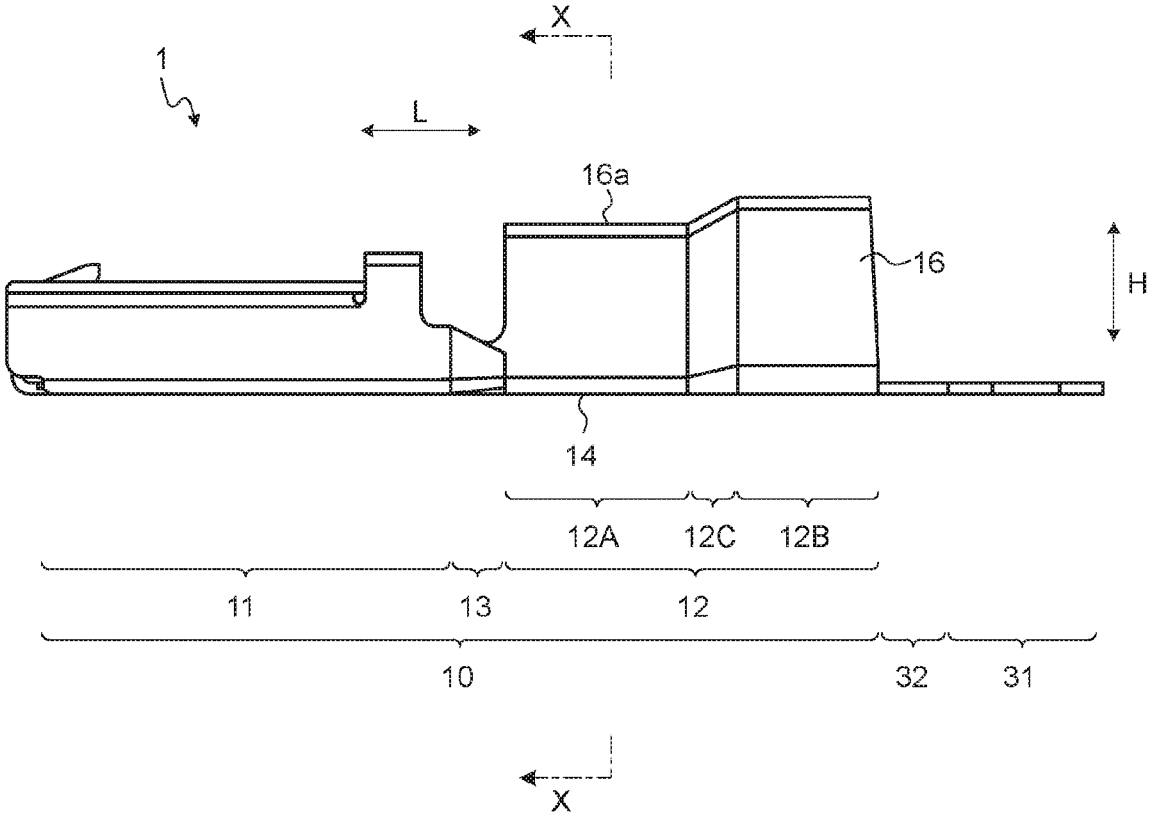
FIG. 2 is a side view of the crimp terminal according to the embodiment, depicting a state in which an electric wire connecting portion is formed in a U-shape.
Figure 3:
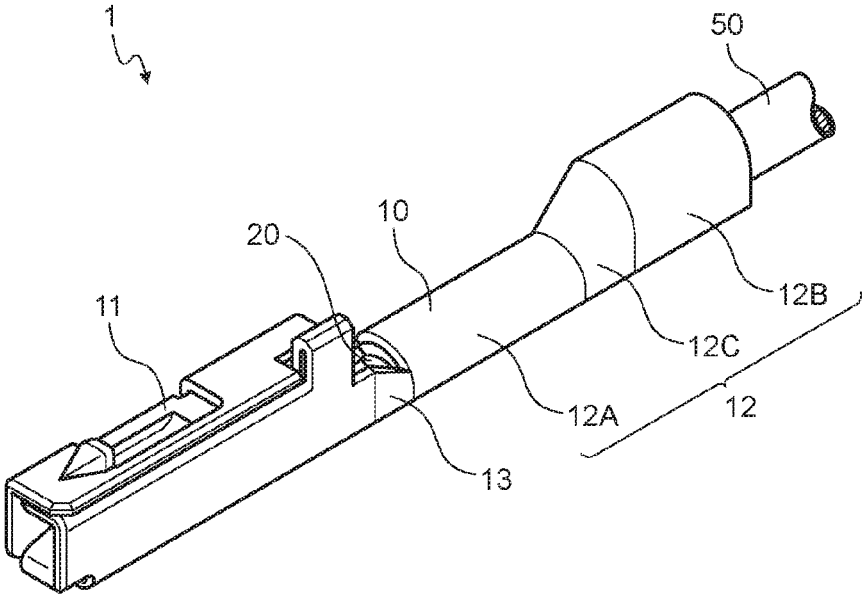
FIG. 3 is a perspective view illustrating the crimp terminal after crimping is completed in the embodiment.
Figure 4:
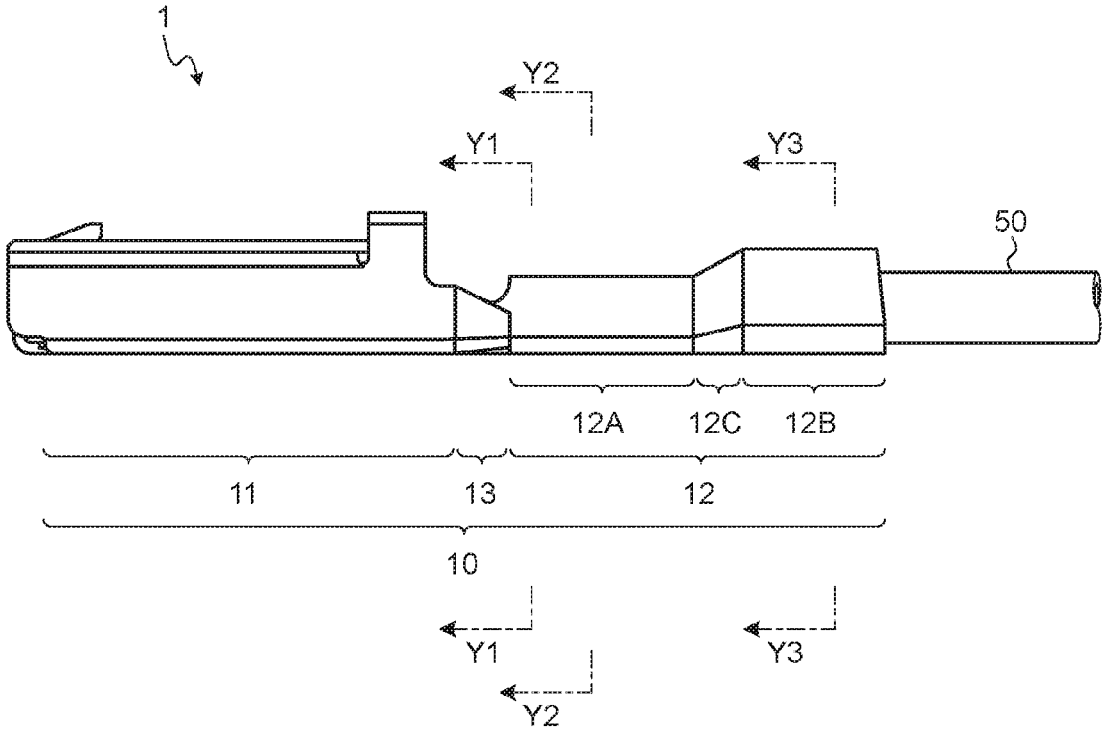
FIG. 4 is a side view illustrating the crimp terminal after crimping is completed in the embodiment.

Embodiments of a crimp terminal according to the present invention will now be described with reference to the drawings. It should be noted that the present invention is not limited to these embodiments.

Embodiment

One of the embodiments of the crimp terminal according to the present invention will be described with reference to FIG. 1 to FIG. 25.

The numeral 1 in FIG. 1 to FIG. 4 denotes a crimp terminal according to the present embodiment. This crimp terminal 1 is electrically connected to an electric wire 50, and is electrically connected to a counterpart terminal (not depicted) while being integrated with this electric wire 50. Herein, from the electric wire 50 at its end portion, so as to expose a core wire 51 by a predetermined length, a coating 52 is peeled and removed by the length. The core wire 51 may be an assembly of a plurality of element wires or may be a solid wire such as a coaxial cable. In order to be electrically connected to the electric wire 50, the crimp terminal 1 is crimped onto the end portion of the electric wire 50, thereby electrically being connected to the exposed core wire 51 at the distal end (hereinafter, simply called "distal-end core wire").

Specifically, the crimp terminal 1 includes a terminal fitting 10 and a water stop member 20.

Figure 5:
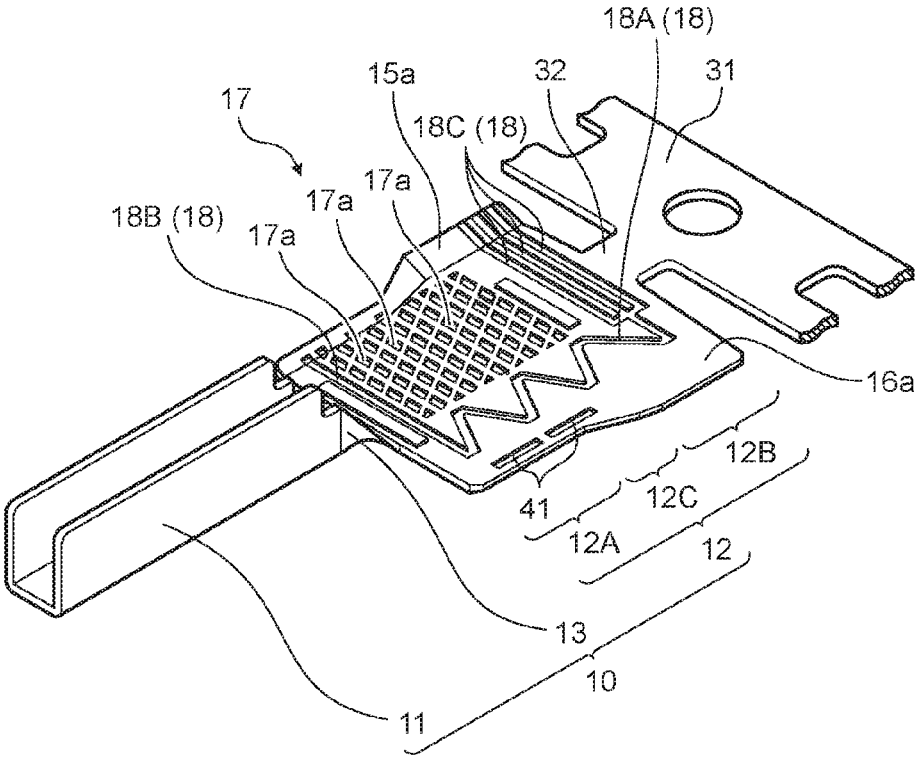
FIG. 5 is a perspective view illustrating a terminal fitting of the crimp terminal according to the embodiment, depicting a state before a water stop member is pasted.
Figure 6:
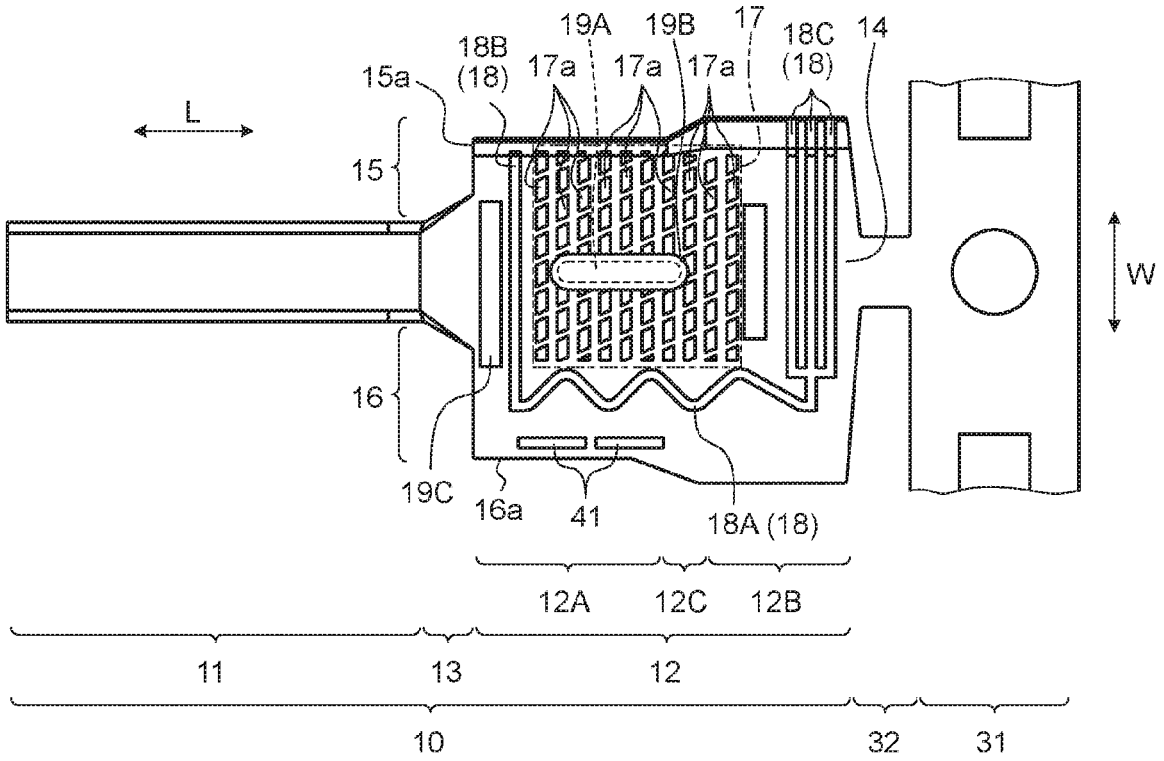
FIG. 6 is a top view illustrating the terminal fitting of the crimp terminal according to the embodiment, depicting a state before the water stop member is pasted.

The terminal fitting 10 is a main part in the crimp terminal 1, and is formed of a conductive metal plate (e.g., copper plate) in a predetermined shape connectable to the counterpart terminal and the electric wire 50. As depicted in FIG. 5 and FIG. 6, this terminal fitting 10 has a terminal connecting portion 11 that is electrically connected to the counterpart terminal and an electric wire connecting portion 12 that is electrically connected to the electric wire 50. The terminal connecting portion 11 and the electric wire connecting portion 12 are coupled by a coupling portion 13 interposed therebetween.

The terminal fitting 10 may be a male terminal, or may be a female terminal. The terminal connecting portion 11 is formed in a male shape when the terminal fitting 10 is a male terminal, and is formed in a female shape when the terminal fitting 10 is a female terminal. In the present embodiment, the female terminal is exemplified.

Herein, in the crimp terminal 1, the direction of connection (insertion direction) between the crimp terminal and the counterpart terminal is defined as a first direction L indicating a longitudinal direction. The direction of later-described parallel arrangement of the crimp terminal 1 is defined as a second direction W indicating a width direction of the crimp terminal 1. In the crimp terminal 1, the direction orthogonal to each of the first direction L and the second direction W is defined as a third direction H indicating a height direction.

Figure 7:
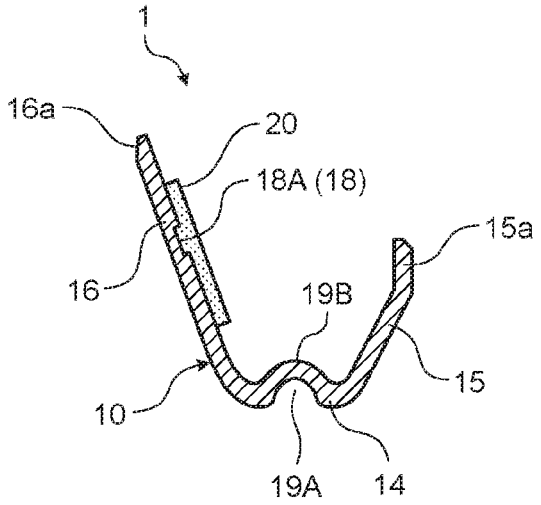
FIG. 7 is a diagram illustrating a cross-sectional area of the electric wire connecting portion taken along line X-X in FIG. 2.

The electric wire connecting portion 12 is formed in a shape of one plate (FIG. 5 and FIG. 6) first. After a predetermined processing described later is performed thereon, the electric wire connecting portion is formed in a U-shape for a state immediately before being connected to the electric wire 50 (FIG. 1 and FIG. 7). The electric wire connecting portion 12 is then wound around the electric wire 50 with the end portion of the electric wire 50 being placed thereon, thereby being crimped on the end portion of the electric wire 50 to come into contact with the distal-end core wire 51.

The electric wire connecting portion 12 can be divided into an area of a bottom portion 14, an area of a first barrel piece portion 15, and an area of a second barrel piece portion 16. The bottom portion 14 is a portion serving as a bottom wall of the U-shaped electric wire connecting portion 12, and the end portion of the electric wire 50 is placed thereon in crimping. The first and the second barrel piece portions 15 and 16 are portions serving as side walls of the U-shaped electric wire connecting portion 12, and each extend from both ends of the bottom portion 14 in the second direction W. In the U-shaped electric wire connecting portion 12, the first and the second barrel piece portions 15 and 16 extend from both ends of the bottom portion 14 so as to surround the end portion of the electric wire 50.

Figure 8:
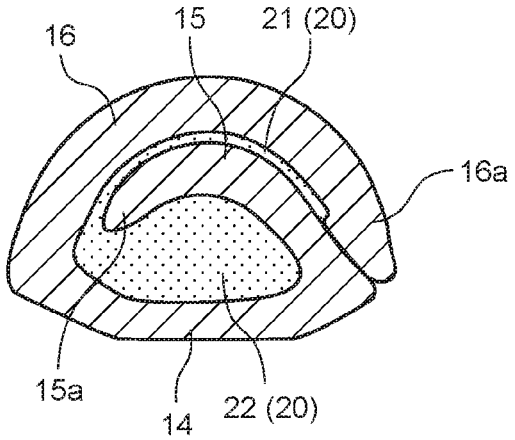
FIG. 8 is a diagram illustrating a cross-sectional area of the electric wire connecting portion taken along line Y1-Y1 in FIG. 4.
Figure 9:
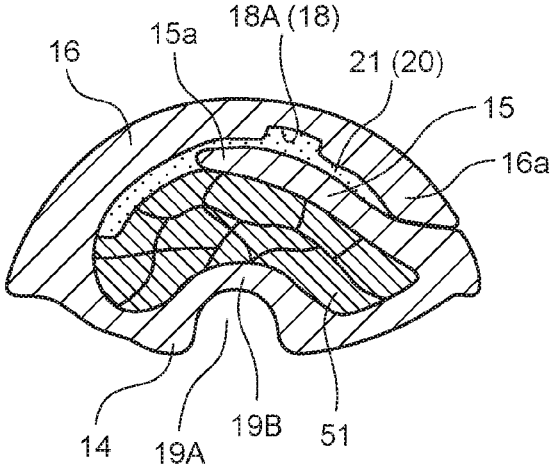
FIG. 9 is a diagram illustrating a cross-sectional area of the electric wire connecting portion taken along line Y2-Y2 in FIG. 4.
Figure 10:
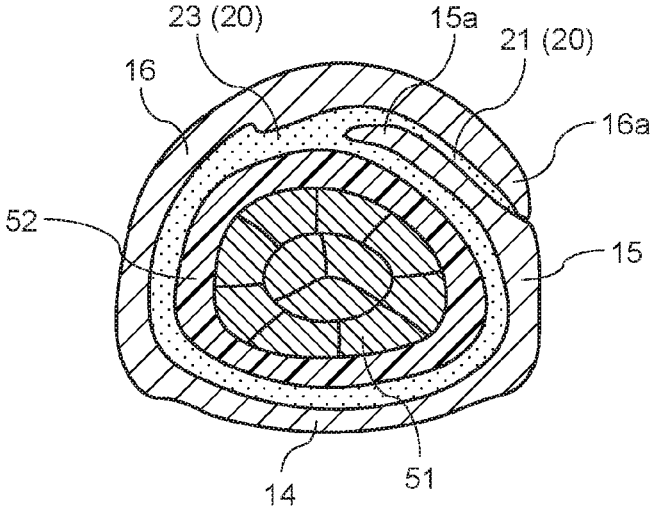
FIG. 10 is a diagram illustrating a cross-sectional area of the electric wire connecting portion taken along line Y3-Y3 in FIG. 4.

The first barrel piece portion 15 and the second barrel piece portion 16 are formed such that one of lengths from basal portions thereof on the bottom portion 14 side to end surfaces of distal ends 15*a* and 16*a* is longer than the other of the lengths. Thus, one of the respective distal ends 15*a* and 16*a* of the first and the second barrel piece portions 15 and 16 protrudes in the third direction H more than the other does in the U-shaped electric wire connecting portion 12. In this example, the second barrel piece portion 16 extends from the bottom portion 14 longer than the first barrel piece portion 15 does (FIG. 1 and FIG. 7). Accordingly, in the electric wire connecting portion 12, after crimping is completed (hereinafter, called "after crimp completion"), an area in which the first barrel piece portion 15 and the second barrel piece portion 16 overlap each other (hereinafter, called "overlap area") is formed (FIG. 8 to FIG. 10). This overlap area is specifically an area in which, after crimp completion, an outer wall surface of the first barrel piece portion 15 and an inner wall surface of the second barrel piece portion 16 face each other. In other words, in this electric wire connecting portion 12, the first barrel piece portion 15 is a barrel piece portion to be wound inside around the end portion of the electric wire 50, and the second barrel piece portion 16 is a barrel piece portion to be wound outside around the end portion of the electric wire 50. Thus, during crimping process, the first barrel piece portion 15 is wound on the outer peripheral surface of the end portion of the electric wire 50, and so as to cover the end portion of the electric wire 50 and the first barrel piece portion 15 in this state, the second barrel piece portion 16 is wound thereon. In the electric wire connecting portion 12, the first barrel piece portion 15 and the second barrel piece portion 16 are swaged on the end portion of the electric wire 50 in the above-described manner.

Herein, the end portion of the electric wire 50 is inserted into a U-shaped inner space from a U-shaped opening side (opening formed between end surfaces of the respective distal ends 15*a* and 16*a*) of the electric wire connecting portion 12. Thus, in the electric wire connecting portion 12, in order to facilitate insertion of the end portion of the electric wire 50, spacing between the first barrel piece portion 15 and the second barrel piece portion 16 becomes larger from the bottom portion 14 side toward the opening side (distal ends 15*a* and 16*a* side).

Furthermore, the electric wire connecting portion 12 can be divided into an area of a core wire crimp portion 12A, an area of a coating crimp portion 12B, and an area of a coupling crimp portion 12C (FIG. 2 and FIG. 4 to FIG. 6). The core wire crimp portion 12A is a portion in which part of each of the first and the second barrel piece portions 15 and 16 is crimped on the distal-end core wire 51 by winding the respective first and second barrel piece portions 15 and 16 around the end portion of the electric wire 50, and is connected continuously to the coupling portion 13. The coating crimp portion 12B is a portion that is crimped on the coating 52 extending up to the basal portion in the exposed area of the distal-end core wire 51. The coupling crimp portion 12C is a portion that couples the core wire crimp portion 12A and the coating crimp portion 12B together and is crimped on the end portion of the electric wire 50.

Figure 11:
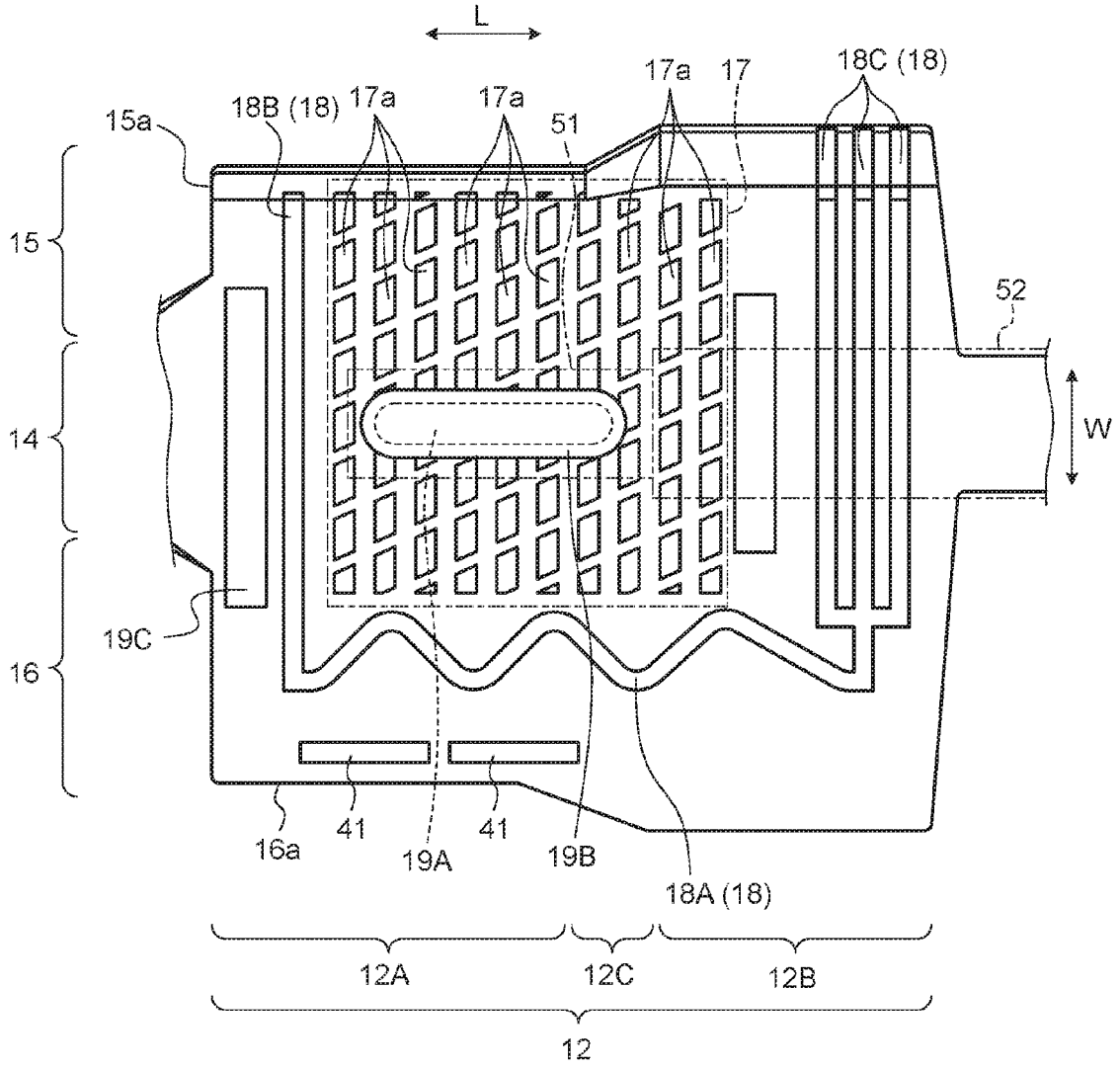
FIG. 11 is a diagram for explaining the electric wire connecting portion before the water stop member is pasted.

On an inner wall surface (wall surface on the side covering the electric wire 50) of the electric wire connecting portion 12, a core wire holding area (hereinafter, called "serration area") 17 for holding the crimped distal-end core wire 51 is formed (FIG. 11). This serration area 17 is arranged at least in an area that is wound around the distal-end core wire 51 within the inner wall surface of the electric wire connecting portion 12. The serration area 17 in this example is formed so as to cover the entire distal-end core wire 51. Thus, in the first direction L, the serration area 17 is formed between an area on the terminal connecting portion 11 side with respect to the distal end position of the distal-end core wire 51 placed on the inner wall surface and an area on which the coating 52 is placed. In the second direction W, the serration area 17 is formed between an area of the first barrel piece portion 15 on the distal end 15*a* side and an area of the second barrel piece portion 16 that is in contact with at least the distal-end core wire 51 after crimp completion. In this example, the serration area 17 is formed also on the distal end 16*a* side with respect to the area being in contact with the distal-end core wire 51. Specifically, the serration area 17 of the present embodiment is an area in which a plurality of depressions, a plurality of projections, or a plurality of depressions and a plurality of projections in combination are aligned in a rectangular shape, which is configured to increase the contact area between the electric wire connecting portion 12 and the distal-end core wire 51 with the depressions or the projections thereby enhancing the close contact strength therebetween. In this example, the serration area 17 having a rectangular shape is formed by a plurality of depressions 17*a*.

Figure 12:
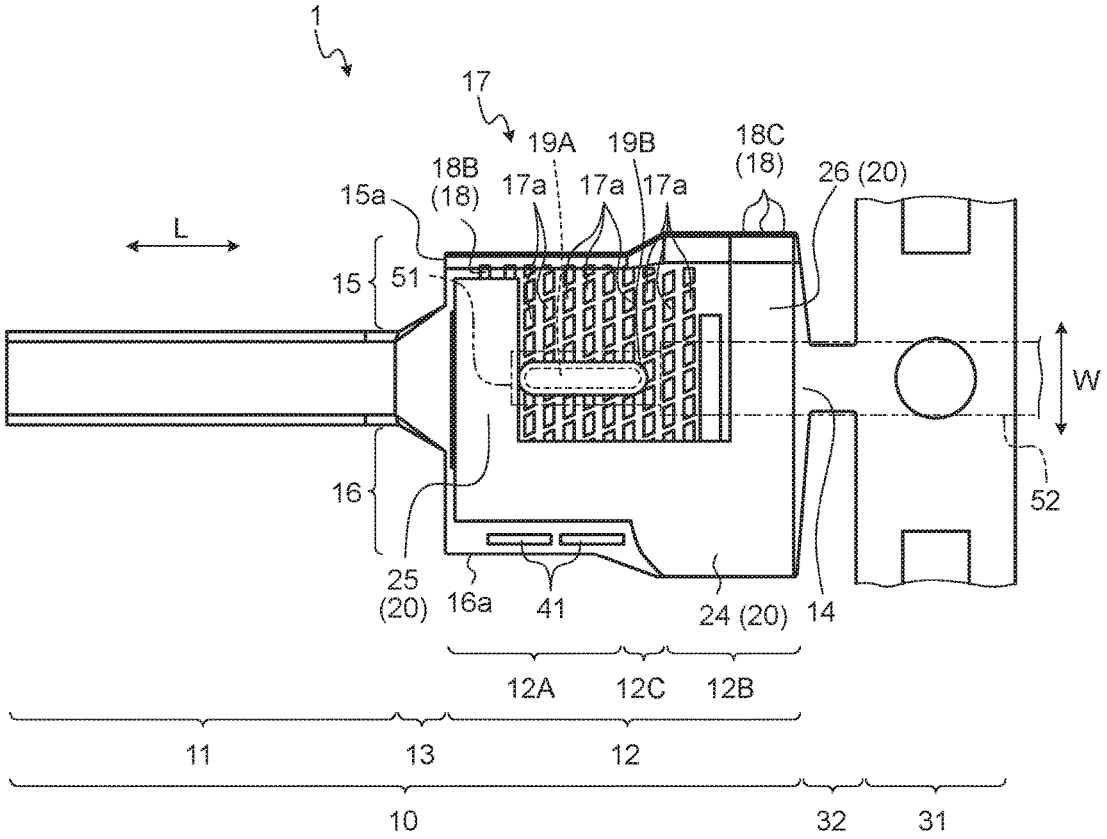
FIG. 12 is a top view illustrating the crimp terminal according to the embodiment, depicting a state after the water stop member is pasted.
Figure 13:
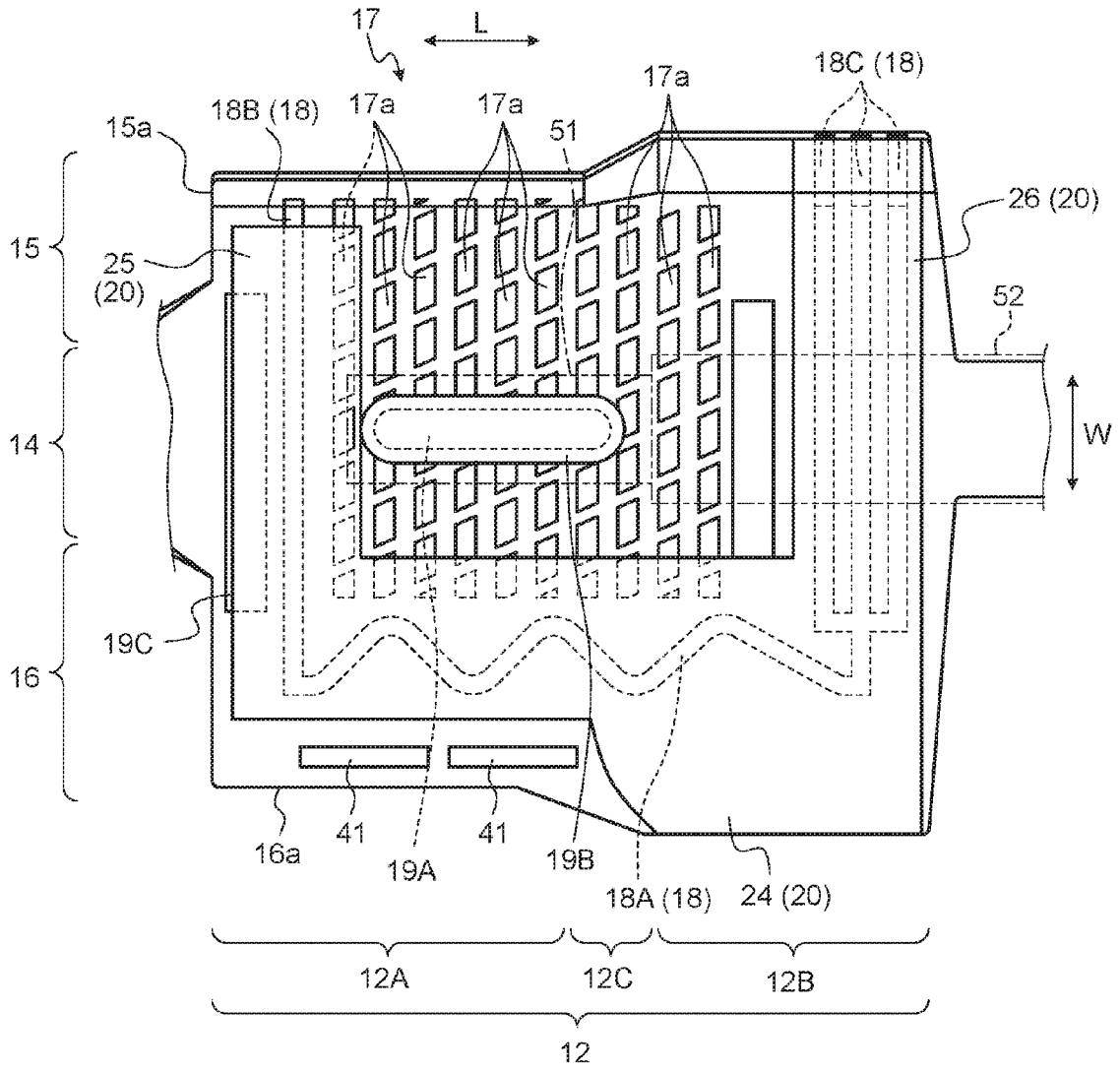
FIG. 13 is a diagram for explaining the electric wire connecting portion and the water stop member before being formed in a U-shape.

The electric wire connecting portion 12 and the distal-end core wire 51 need to be electrically connected to each other. In view of this, entry of water therebetween may deteriorate the durability, and thus is not preferable. For example, when the electric wire connecting portion 12 and the core wire 51 are formed of different types of metallic materials (e.g., copper and aluminum) having significantly different ionization tendencies, entry of water therebetween may corrode the aluminum side in particular. In view of this, this crimp terminal 1 is provided with the water stop member 20 for suppressing water entry between the electric wire connecting portion 12 and the distal-end core wire 51 (FIG. 12 and FIG. 13). The water stop member 20 is a member formed in a sheet shape, and is mainly made of adhesive such as modified acrylic adhesive. For example, as the water stop member 20, a member is used that is prepared by impregnating a nonwoven fabric sheet with the adhesive and has adhesiveness on both surfaces of the sheet.

The water stop member 20 forms first to third water stop areas 21, 22, and 23 after crimp completion (FIG. 8 to FIG. 10). In order to specifically arrange these first to third water stop areas 21, 22, and 23, the water stop member 20 is formed in a predetermined shape, and is then pasted on the inner wall surface of the electric wire connecting portion 12 in a plate shape as depicted in FIG. 6.

The first water stop area 21 is an area in which the water stop member 20 is interposed at least between the outer wall surface of the first barrel piece portion 15 and the inner wall surface of the second barrel piece portion 16 (i.e., in the overlap area) after crimp completion (FIG. 8 to FIG. 10), and serves as an area for suppressing water entry from therebetween into between the electric wire connecting portion 12 and the distal-end core wire 51. Thus, the first water stop area 21 extends between the terminal connecting portion 11 side with respect to the distal end position of the distal-end core wire 51 and the coating 52 side with respect to the basal portion of the distal-end core wire 51. The first water stop area 21 is formed by the first water stop portion 24 of the water stop member 20 (FIG. 13).

The first water stop portion 24 is arranged between the distal end 16*a* side and the bottom portion 14 side in the second barrel piece portion 16, all over between the terminal connecting portion 11 side with respect to the distal end position of the distal-end core wire 51 and the coating 52 side with respect to the basal portion of the distal-end core wire 51. The first water stop portion 24 on the bottom portion 14 side extends up to a position that covers an entire area of the serration area 17 on the second barrel piece portion 16 side. Thus, the first water stop area 21 of this example is formed not only on the overlap area but also between the inner wall surface of the second barrel piece portion 16 and the distal-end core wire 51 (FIG. 9) within a range in which electrical connection between the second barrel piece portion 16 and the distal-end core wire 51 is not inhibited.

The second water stop area 22 is an area that is, inside the electric wire connecting portion 12 at least after crimp completion, positioned on the terminal connecting portion 11 side with respect to the distal end of the distal-end core wire 51 and into which the water stop member 20 is charged (FIG. 8), and serves as an area for suppressing water entry from the terminal connecting portion 11 side into between the electric wire connecting portion 12 and the distal-end core wire 51. The second water stop area 22 is formed mainly by the second water stop portion 25 of the water stop member 20 (FIG. 13).

The second water stop portion 25 arranged between the first barrel piece portion 15 on the distal end 15*a* side and the first water stop portion 24, all over between the terminal connecting portion 11 side with respect to the distal end position of the distal-end core wire 51 and the distal end portion side of the distal-end core wire 51. The second water stop portion 25 of this example is arranged so as to extend over the distal end area of the distal-end core wire 51. Thus, in the second water stop area 22 of this example, also the distal end portion of the core wire 51 is covered by the water stop member 20 (the second water stop portion 25). The second water stop portion 25 of this example is connected continuously to the first water stop portion 24. Thus, the second water stop area 22 of this example is formed by the second water stop portion 25 and a portion (on the bottom portion 14 side with respect to the overlap area) of the first water stop portion 24 connected continuously to the second water stop portion 25.

The third water stop area 23 is an area in which the water stop member 20 is interposed at least between the inner wall surface of the electric wire connecting portion 12 (specifically, the coating crimp portion 12B) and the coating 52 after crimp completion (FIG. 10), and serves as an area for suppressing water entry from therebetween into between the electric wire connecting portion 12 and the distal-end core wire 51. The third water stop area 23 is formed mainly by the third water stop portion 26 of the water stop member 20 (FIG. 13).

The third water stop portion 26 is arranged, between the first barrel piece portion 15 on the distal end 15*a* side and the first water stop portion 24, in an area that is wound around the coating 52 in the electric wire connecting portion 12. The third water stop portion 26 of this example is connected continuously to the first water stop portion 24. Thus, the third water stop area 23 is formed by the third water stop portion 26 and a portion (on the bottom portion 14 side with respect to the overlap area) of the first water stop portion 24 connected continuously to the third water stop portion 26.

The water stop member 20 in the above-described shape is arranged on the inner wall surface of the electric wire connecting portion 12, thereby being formed as the first to the third water stop areas 21, 22, and 23 in a connected state after crimp completion. The first to the third water stop areas 21, 22, and 23 block communication between the end portion of the electric wire 50 and the outside in the electric wire connecting portion 12. Thus, the water stop member 20 can suppress water entry between the electric wire connecting portion 12 and the distal-end core wire 51.

The terminal fitting 10 described above is processed in a form having the plate-shaped electric wire connecting portion 12 depicted in FIG. 6 through a pressing process performed on one metallic plate, and in a subsequent water-stop-member pasting process, the water stop member 20 is pasted on the plate-shaped electric wire connecting portion 12. Subsequently, this terminal fitting 10 is subjected to a bending process, whereby the terminal connecting portion 11 and the U-shaped electric wire connecting portion 12 are formed.

Figure 14:
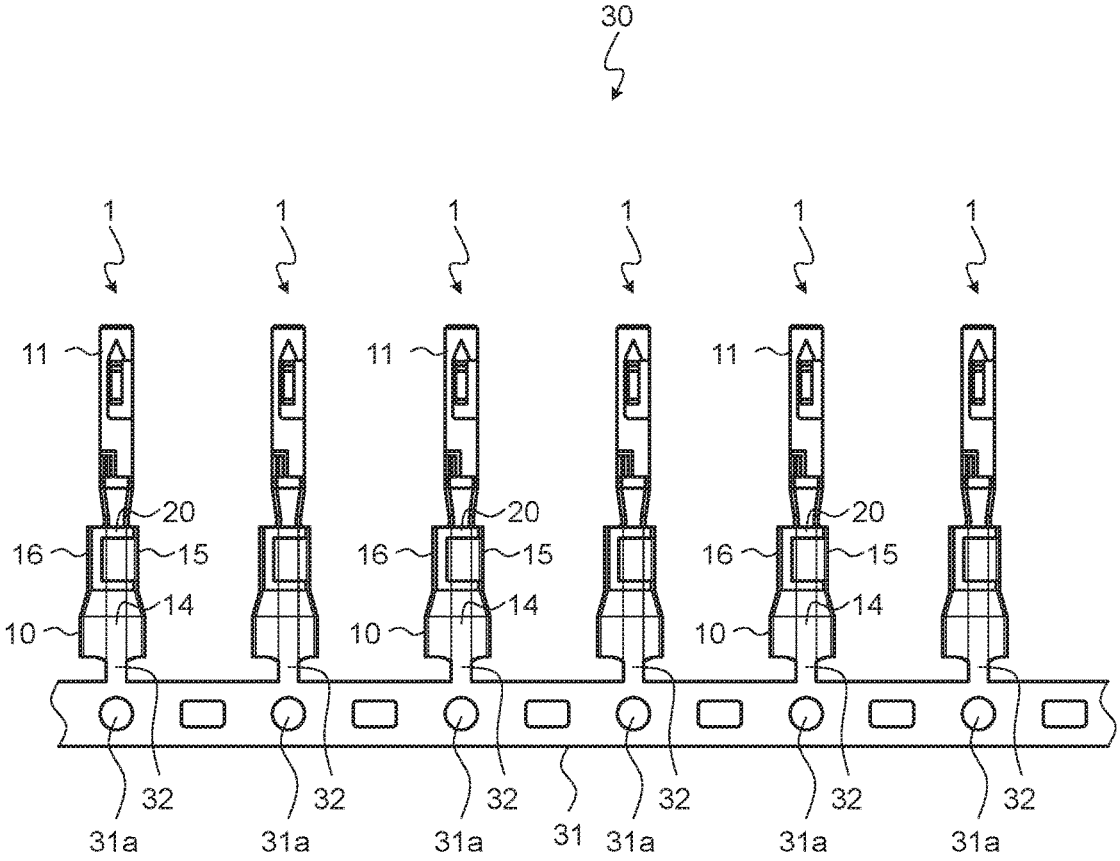
FIG. 14 is a diagram for explaining a chained-terminals body.

The crimp terminal 1 that has undergone the above-described processes is formed in plurality in an aligned manner as a chain body (hereinafter, called "chained-terminals body") 30 (FIG. 14). The chained-terminals body 30 means an assembly of a plurality of crimp terminals 1 that are arranged parallel at regular intervals while being oriented in the same direction and are connected in a continuous chain shape. In the chained-terminals body 30, end portions of all crimp terminals 1 on one side are connected by a connecting band 31. The connecting band 31 is formed in a rectangular plate shape, for example, and is arranged with a predetermined distance spaced apart from the electric wire connecting portions 12 of all crimp terminals 1. The bottom portions 14 of the electric wire connecting portions 12 are connected to the connecting band 31, with a joint portion 32 having a rectangular plate shape, for example, interposed therebetween for each crimp terminal 1. On the connecting band 31, through holes (hereinafter, called "terminal feed holes") 31*a* for feeding the chained-terminals body 30 to a crimp position of a terminal crimping device 100 are formed at regular intervals along a direction in which the chained-terminals body 30 is fed. The chained-terminals body 30 thus formed is placed on the terminal crimping device 100 while being wound in a reel-like shape (not depicted). The crimp terminals 1 are crimped on the corresponding electric wires 50, and are then cut off from the chained-terminals body 30.

The following describes the terminal crimping device 100.

Figure 15:
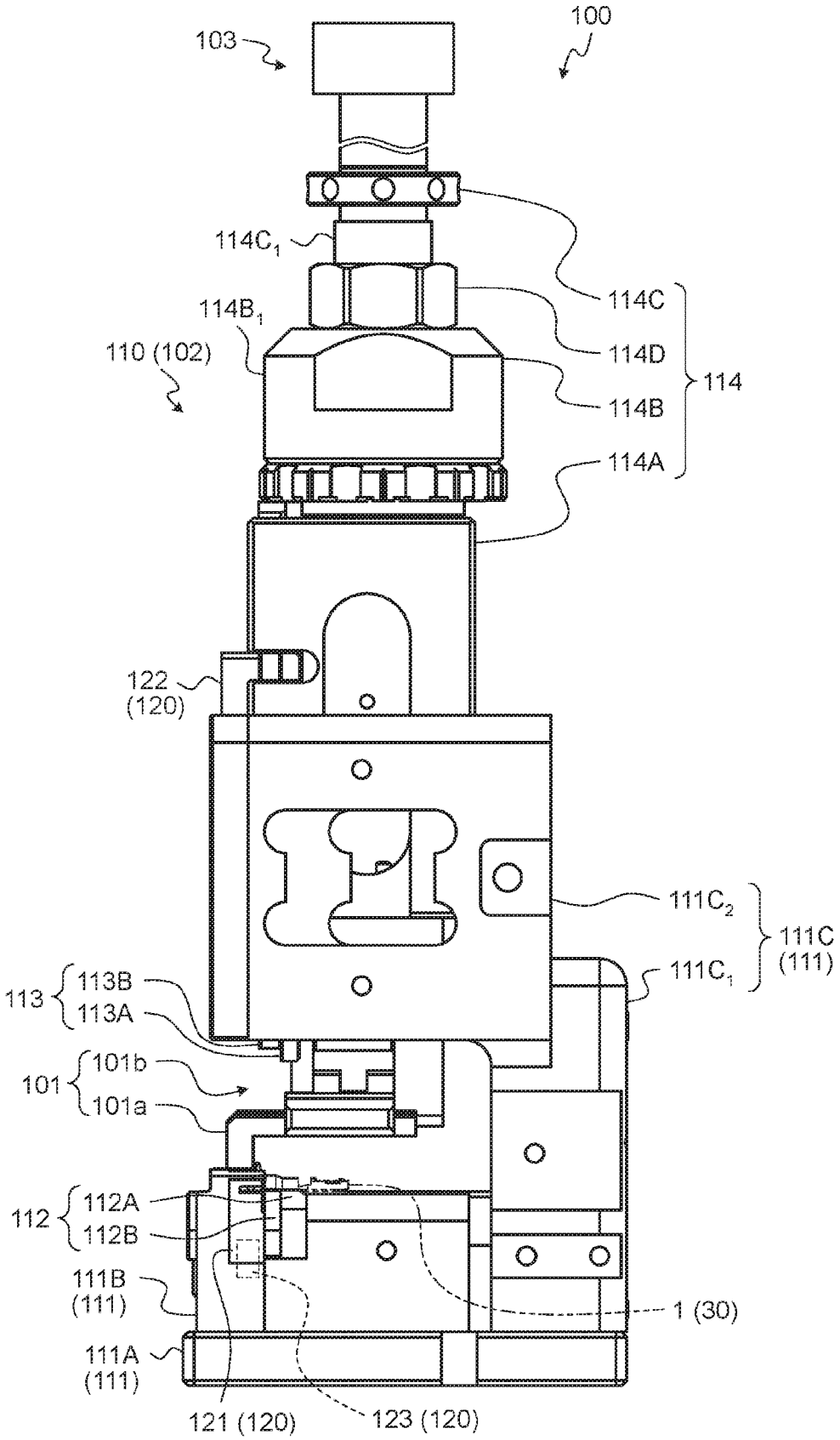
FIG. 15 is a diagram for explaining a terminal crimping device according to the embodiment.

As depicted in FIG. 15, the terminal crimping device 100 includes a terminal supply device 101 that supplies a crimp terminal 1 to a predetermined crimp position, a crimping device 102 that crimps the crimp terminal 1 on an electric wire 50 in the crimp position, and a drive unit 103 that causes the terminal supply device 101 and the crimping device 102 to operate. The terminal supply device 101 and the crimping device 102 are devices that are called applicators in this technical field.

The terminal supply device 101 pulls out a leading crimp terminal 1 on the outer peripheral side of the chained-terminals body 30 that is wound in a reel-like shape, and sequentially supplies crimp terminals 1 to the crimp position. After crimping this leading crimp terminal 1 on an electric wire 50 and cutting this crimped terminal from the chained-terminals body 30, the terminal supply device 101 supplies a next leading crimp terminal 1 to the crimp position. Operation of the terminal supply device 101 is sequentially repeated every time crimping and cutting are performed.

The terminal supply device 101 has a structure known in this technical field, and includes a terminal feeding member 101*a* that is inserted into each terminal feed hole 31*a* of the connecting band 31 and a power transmission mechanism 101*b* that causes the terminal feeding member 101*a* to be driven by power of the drive unit 103. The power transmission mechanism 101*b* is structured as a link mechanism that operates in conjunction with crimping operation (vertical movement of a ram 114A described later, for example) of the crimping device 102. The terminal supply device 101 of this example causes the terminal feeding member 101*a* to be driven in the vertical direction and the lateral direction in conjunction with the crimping operation of the crimping device 102, thereby supplying the crimp terminal 1 to the crimp position.

The crimping device 102 crimps the supplied crimp terminal 1 on the electric wire 50, and cuts off this crimp terminal 1 from the chained-terminals body 30. For this operation, the crimping device 102 includes a crimping unit 110 and a terminal cutting unit 120.

The crimping unit 110 is a device that swages the crimp terminal 1 supplied to the crimp position onto the end portion of the electric wire 50, thereby crimping this crimp terminal 1 on the electric wire 50. The crimping unit 110 of this example swages the first barrel piece portion 15 and the second barrel piece portion 16 in the crimp terminal 1 onto each of the distal-end core wire 51 and the coating 52 in the electric wire 50, thereby crimping this crimp terminal 1 on the electric wire 50. The crimping unit 110 includes a frame 111, a first die 112 and a second die 113 used in a pair, and a power transmission mechanism 114.

The frame 111 includes a base 111A, an anvil support body 111B, and a support body for the power transmission mechanism 114 (hereinafter, called "transmission support body") 111C. The base 111A is fixed onto, for example, a mounting table (not depicted) on which the terminal crimping device 100 is mounted. The anvil support body 111B and the transmission support body 111C are fixed on the base 111A. The transmission support body 111C is disposed behind (on the right side in the plane of the paper in FIG. 15) and above (on the upper side in the plane of the paper in FIG. 15) the anvil support body 111B. Specifically, the transmission support body 111C has a vertically disposed portion 111$C_1$ that is vertically disposed upward from the base 111A behind the anvil support body 111B and a ram support portion 111$C_2$ that is held on an upper portion of the vertically disposed portion 111$C_1$. The ram support portion 111$C_2$ is a support body supporting the ram 114A described later, and is disposed above the anvil support body 111B with a predetermined distance spaced apart.

Figure 16:
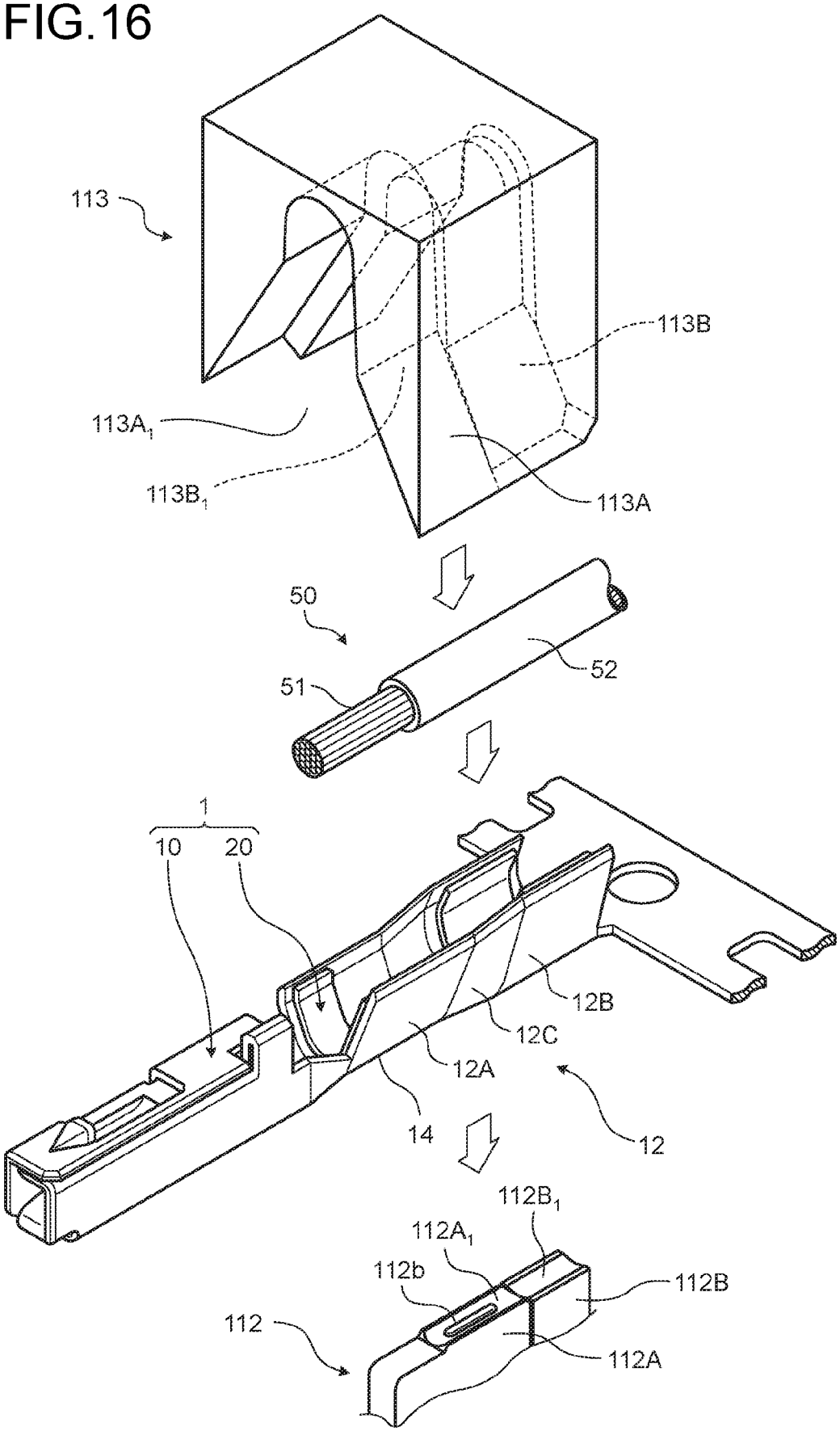
FIG. 16 is a perspective view for explaining first and second dies according to the embodiment.

The first die 112 and the second die 113 are crimp-forming dies disposed in a manner vertically spaced apart from each other, and configured to pinch the crimp terminal 1 and the end portion of the electric wire 50 placed between these dies, thereby crimping the crimp terminal 1 on the end portion of the electric wire 50 (FIG. 16). The first die 112 is formed of two lower dies, and has a first anvil 112A and a second anvil 112B as the lower dies. The second die 113 is formed of two upper dies, and has a first crimper 113A and a second crimper 113B as the upper dies. The first anvil 112A and the first crimper 113A are disposed in a manner facing each other in the vertical direction, and the distance therebetween is narrowed, whereby the U-shaped core wire crimp portion 12A is crimped on the distal-end core wire 51. The second anvil 112B and the second crimper 113B are disposed in a manner facing each other in the vertical direction, and the distance therebetween is narrowed, whereby the U-shaped coating crimp portion 12B is crimped on the coating 52.

In this crimping, the drive unit 103 transmits power thereof to the power transmission mechanism 114, thereby narrowing the distance between the first anvil 112A and the first crimper 113A and the distance between the second anvil 112B and the second crimper 113B. After the crimping, the drive unit widens the distance between the first anvil 112A and the first crimper 113A and the distance between the second anvil 112B and the second crimper 113B. In this example, by vertically moving the second die 113 with respect to the first die 112, the first crimper 113A and the second crimper 113B are vertically moved simultaneously with respect to the first anvil 112A and the second anvil 112B. Herein, the first anvil 112A, the second anvil 112B, the first crimper 113A, and the second crimper 113B may be formed bodies that are independently formed. In this case, the drive unit 103 and the power transmission mechanism 114 may vertically move the first crimper 113A and the second crimper 113B separately. In this example, after crimping of the core wire crimp portion 12A is started by the first anvil 112A and the first crimper 113A, crimping of the coating crimp portion 12B by the second anvil 112B and the second crimper 113B is started.

The power transmission mechanism 114 of the present embodiment is a mechanism that transmits power output from the drive unit 103 to the first crimper 113A and the second crimper 113B, and includes the ram 114A, a ram bolt 114B, and a shank 114C as depicted in FIG. 15.

The ram 114A is a movable member that is supported in a manner vertically movable with respect to the ram support portion 111$C_2$. To the ram 114A, the second die 113 is fixed. Thus, the first crimper 113A and the second crimper 113B can vertically move integrally with the ram 114A with respect to the ram support portion 111$C_2$. For example, the ram 114A is formed in a rectangular parallelepiped shape. In the ram 114A, a female screw portion (not depicted) is formed. This female screw portion is formed on the inner peripheral surface of a vertical hole formed from the inside toward the upper end surface of the ram 114A.

The ram bolt 114B has a male screw portion (not depicted) that is screwed into the female screw portion of the ram 114A. Thus, the ram bolt 114B can vertically move integrally with the ram 114A with respect to the ram support portion 111$C_2$. The ram bolt 114B has a bolt head portion 114$B_1$ that is disposed above the male screw portion. In the bolt head portion 114$B_1$, a female screw portion (not depicted) is formed. This female screw portion is formed on the inner peripheral surface of a vertical hole that is formed from the inside toward the upper end surface of the bolt head portion 114$B_1$.

The shank 114C is a cylindrical hollow member having at end portions thereof a male screw portion 114$C_1$ and a connection portion (not depicted). The male screw portion 114$C_1$ of the shank 114C is formed on the lower side of the hollow member, and is screwed into the female screw portion of the bolt head portion 114$B_1$ of the ram bolt 114B. Thus, the shank 114C can vertically move integrally with the ram 114A and the ram bolt 114B with respect to the ram support portion 111$C_2$. The connection portion is connected to the drive unit 103.

The drive unit 103 has a drive source (not depicted) and a power conversion mechanism (not depicted) that converts driving force of the drive source into power in the vertical direction. The connection portion of the shank 114C is coupled to an output shaft of the power conversion mechanism. Thus, the first crimper 113A and the second crimper 113B are vertically moved by the output (output of the power conversion mechanism) of the drive unit 103 integrally with the ram 114A, the ram bolt 114B, and the shank 114C with respect to the ram support portion 111$C_2$. Examples of the drive source that can be used include a motorized actuator such as a motor, a hydraulic actuator such as a hydraulic cylinder, and a pneumatic actuator such as an air cylinder.

Herein, the relative position of the first crimper 113A with respect to the first anvil 112A in the vertical direction and the relative position of the second crimper 113B with respect to the second anvil 112B in the vertical direction can be changed by adjusting the screwed amount between the female screw portion of the bolt head portion 114$B_1$ and the male screw portion 114$C_1$ of the shank 114C. A nut 114D is screwed onto the male screw portion 114$C_1$ of the shank 114C above the ram bolt 114B, and serves as what is called a locknut together with the female screw portion of the bolt head portion 114$B_1$. Thus, this nut 114D is tightened toward the ram bolt 114B after the adjustment of the relative position described above is completed, whereby the first crimper 113A and the second crimper 113B can be fixed at this relative position.

On the upper distal ends of the first anvil 112A and the second anvil 112B, recessed surfaces 112$A_1$ and 112$B_1$ recessed downward are formed, respectively (FIG. 16). The recessed surfaces 112$A_1$ and 112$B_1$ are each formed in an arc shape so as to fit the shape of each bottom portion 14 of the U-shaped core wire crimp portion 12A and the U-shaped coating crimp portion 12B. In this crimping unit 110, the respective recessed surfaces 112$A_1$ and 112$B_1$ correspond to the crimp position. The crimp terminal 1 is supplied with the bottom portion 14 facing downward, so that the bottom portion 14 of the core wire crimp portion 12A is placed on the recessed surface 112$A_1$ of the upper end of the first anvil 112A, and the bottom portion 14 of the coating crimp portion 12B is placed on the recessed surface 112$B_1$ of the upper end of the second anvil 112B. The first die 112 is supported by the anvil support body 111B with the respective recessed surfaces 112$A_1$ and 112$B_1$ being exposed upward.

Figure 17:
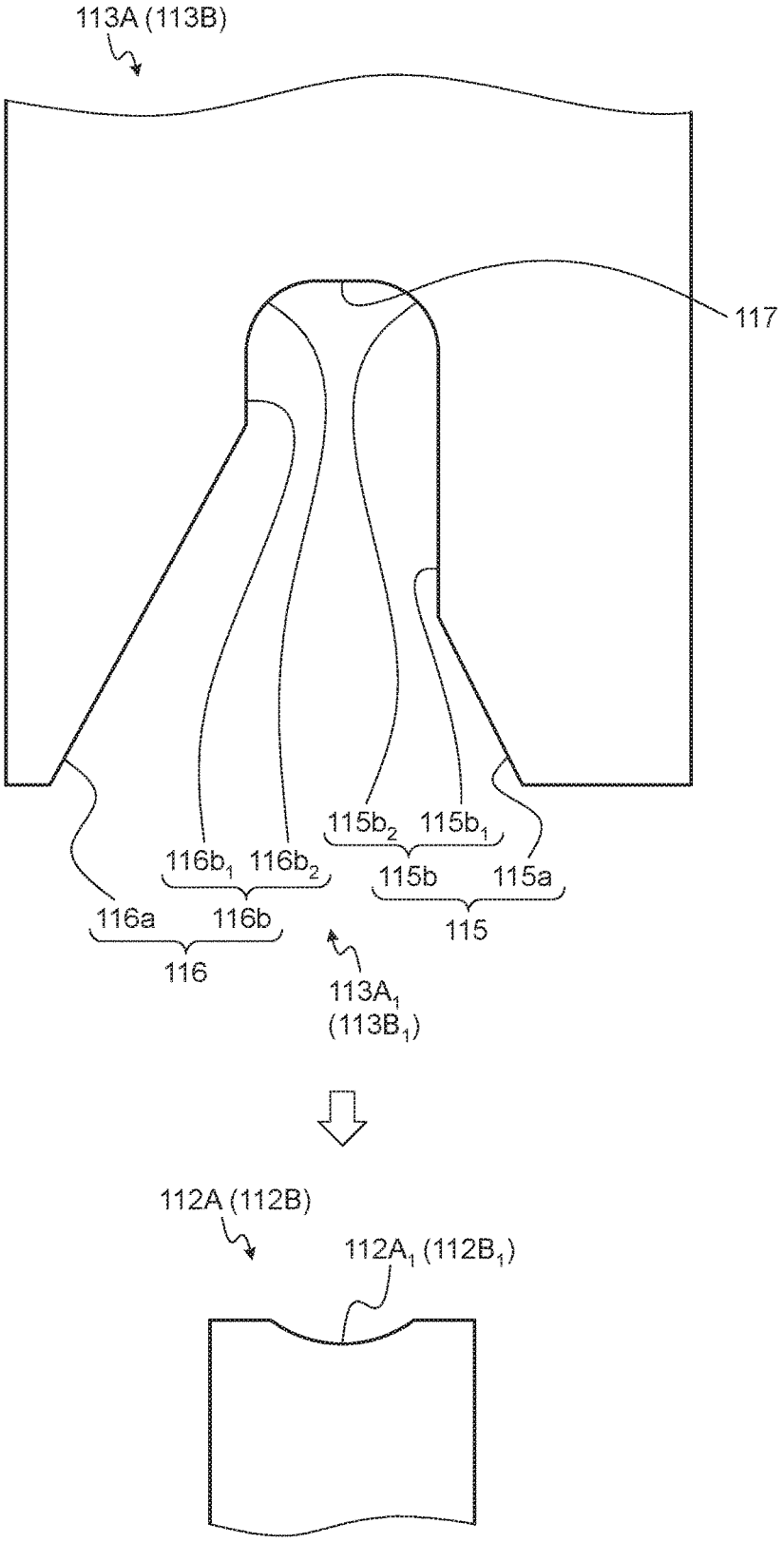
FIG. 17 is a front view for explaining the first and the second dies according to the embodiment.

In the first crimper 113A and the second crimper 113B, recessed portions 113$A_1$ and 113$B_1$ that are recessed upward are formed, respectively (FIG. 16 and FIG. 17). The recessed portions 113$A_1$ and 113$B_1$ are arranged so as to face the recessed surfaces 112$A_1$ and 112$B_1$ of the first anvil 112A and the second anvil 112B, respectively, in the vertical direction. The respective recessed portions 113$A_1$ and 113$B_1$ have first and second wall surfaces 115 and 116 that face each other and a third wall surface 117 that connects the upper ends of the first and the second wall surfaces 115 and 116. The respective recessed portions 113$A_1$ and 113$B_1$ wind the first barrel piece portion 15 and the second barrel piece portion 16 around the end portion of the electric wire 50 to swage them together while bringing the first to the third wall surfaces 115, 116, and 117 into contact with the first barrel piece portion 15 and the second barrel piece portion 16. The respective recessed portions 113$A_1$ and 113$B_1$ are formed so that this crimping operation can be performed.

The first wall surface 115 that comes into initial contact with the first barrel piece portion 15 has a receiving portion 115*a* and an infolding portion 115*b*.

The receiving portion 115*a* is a wall surface that is brought into initial contact with the first barrel piece portion 15, and comes into contact with the distal end 15*a* of the first barrel piece portion 15 when the second die 113 descends. The receiving portion 115*a* is inclined so as to gradually approach the second wall surface 116 with increasing distance from the recessed surfaces 112$A_1$ and 112$B_1$ of the first anvil 112A and the second anvil 112B (i.e., as the surface thereof extends upward). Thus, when the second die 113 descends, the first barrel piece portion 15 is pushed and moved toward the electric wire 50 in the order from the distal end 15*a* side while sliding on the receiving portion 115*a*.

The infolding portion 115*b* is a wall surface for infolding the first barrel piece portion 15 pushed and moved by the receiving portion 115*a* toward the end portion of the electric wire 50. The infolding portion 115*b* has a planar upright surface 115$b_1$ extending upward from a boundary with the receiving portion 115*a* and an arc-shaped surface 115$b_2$ connected continuously to this upright surface 115$b_1$ and configured to infold the first barrel piece portion 15 sliding along the upright surface 115$b_1$ toward the end portion of the electric wire 50 from the distal end 15*a* side. The upright surface 115$b_1$ is a plane extending along the moving direction of the second die 113. The arc-shaped surface 115$b_2$ is a surface that is smoothly connected to the upright surface 115$b_1$, and extends along an arc facing the second wall surface 116. Because the third wall surface 117 is formed in this example, the arc-shaped surface 115$b_2$ is formed such that the upright surface 115$b_1$ and the third wall surface 117 are smoothly connected. By the infolding portion 115*b* thus formed, when the first barrel piece portion 15 has reached the arc-shaped surface 115$b_2$ while sliding on the infolding portion 115*b* as the second die 113 descends, the first barrel piece portion is infolded toward the electric wire 50 in the order from the distal end 15*a* side.

The second wall surface 116 that comes into initial contact with the second barrel piece portion 16 has a receiving portion 116*a* and an infolding portion 116*b* in the same manner as the first wall surface 115.

The receiving portion 116*a* is a wall surface that is brought into initial contact with the second barrel piece portion 16, and comes into contact with the distal end 16*a* of the second barrel piece portion 16 when the second die 113 descends. The receiving portion 116*a* is inclined so as to gradually approaches the first wall surface 115 with increasing distance from the recessed surfaces 112$A_1$ and 112$B_1$ of the first anvil 112A and the second anvil 112B (as the surface thereof extends upward). Thus, when the second die 113 descends, the second barrel piece portion 16 is pushed and moved toward the electric wire 50 in the order from the distal end 16*a* side while sliding on the receiving portion 116*a*.

The infolding portion 116*b* is a wall surface for infolding the second barrel piece portion 16 pushed and moved by the receiving portion 116*a* toward the end portion of the electric wire 50. The infolding portion 116*b* has a planar upright surface 116$b_1$ extending from a boundary with the receiving portion 116*a* and an arc-shaped surface 116$b_2$ connected continuously to this upright surface 116$b_1$ and configured to infold the second barrel piece portion 16 sliding along the upright surface 116$b_1$ toward the end portion of the electric wire 50 from the distal end 16*a* side. The upright surface 116$b_1$ is a plane extending along the moving direction of the second die 113. The arc-shaped surface 116$b_2$ is a surface that is smoothly connected to the upright surface 116$b_1$, and extends along an arc facing the first wall surface 115. Because the third wall surface 117 is formed in this example, the arc-shaped surface 116$b_2$ is formed such that the upright surface 116$b_1$ and the third wall surface 117 are smoothly connected. By the infolding portion 116*b* thus formed, when the second barrel piece portion 16 has reached the arc-shaped surface 116$b_2$ while sliding on the infolding portion 116*b* as the second die 113 descends, the second barrel piece portion 16 is infolded toward the electric wire 50 in the order from the distal end 16*a* side.

The third wall surface 117 is formed in a plane orthogonal to the moving direction (vertical direction) of the second die 113, or in an arc-shaped surface that smoothly connects the arc-shaped surfaces 115$b_2$ and 116$b_2$ of the respective infolding portions 115*b* and 116*b*.

The second barrel piece portion 16 is longer than the first barrel piece portion 15. Thus, when the second die 113 descends, the distal end 16*a* of the second barrel piece portion 16 moves to the third wall surface 117 while moving slidingly on the second wall surface 116, and then moves to the first wall surface 115 while moving slidingly on the third wall surface 117. With the transition of sliding-contact surfaces on the second die 113 side, the second barrel piece portion 16 is wound around the electric wire 50 together with first barrel piece portion 15 while being infolded toward the electric wire 50. During this time, the inner wall surface of the second barrel piece portion 16 pushes and moves the first barrel piece portion 15 toward the electric wire 50 to assist in infolding the first barrel piece portion 15 toward the electric wire 50. Thus, after the first barrel piece portion 15 is infolded by the arc-shaped surface 115$b_2$ toward the electric wire 50, this infolding continues with force being applied by the second barrel piece portion 16, whereby the first barrel piece portion is wound around the electric wire 50.

The crimp terminal 1 that is crimped by the crimping unit 110 as described above is cut off from the connecting band 31 by the terminal cutting unit 120. The terminal cutting unit 120 is a unit that pinches and cuts the joint portion 32 of the crimp terminal 1 supplied to the crimp position with two terminal cutting portions, and performs this cutting off simultaneously with proceeding of the crimping process. The terminal cutting unit 120 is disposed in front of the second anvil 112B (on the left side in the plane of the paper in FIG. 15).

The terminal cutting unit 120 is a unit known in this technical field, and includes a terminal cutting body 121, a depressing member 122, and an elastic member 123. The terminal cutting body 121 is disposed in a manner slidable in the vertical direction along the front surface of the second anvil 112B. In this terminal cutting unit 120, on each of the terminal cutting body 121 and the second anvil 112B, a terminal cutting portion is formed. The depressing member 122 is fixed to the ram 114A, and vertically moves integrally with the ram 114A. The depressing member 122 is disposed above the terminal cutting body 121, and descends to depress the terminal cutting body 121. The elastic member 123 is a member for applying upward biasing force to the terminal cutting body 121, and is formed of a spring member, for example. When depressing force from the depressing member 122 is released, the elastic member 123 returns the terminal cutting body 121 to the initial position in the vertical direction. In the terminal cutting unit 120, when the second die 113 descends during crimping, the depressing member 122 descends together to depress the terminal cutting body 121, thereby cutting the joint portion 32 with the respective terminal cutting portions to cut off the crimp terminal 1 from the chained-terminals body 30.

The electric wire 50 to be crimped is placed at a predetermined position between the terminal cutting body 121 and the depressing member 122. This predetermined position is a position where the end portion of the electric wire 50 before crimping can be positioned above the bottom portion 14 of the plate-shaped electric wire connecting portion 12 and, so as to suppress the distal end position of the distal-end core wire 51 that is depressed when the crimping is started from jutting out from the core wire crimp portion 12A, this core wire 51 can be placed on the bottom portion 14 of the core wire crimp portion 12A. There are occasions when the distal end position of the distal-end core wire 51 stretches in the axial direction farther than the originally placed position during crimping. The predetermined position is preferably determined in consideration of this stretching. In the crimp terminal 1, because the distal end position of the distal-end core wire 51 during crimping is placed on such a position, protrusion of the core wire 51 from the second water stop area 22 can be prevented. Thus, the crimp terminal 1 can keep the waterproof performance with the second water stop area 22.

Herein, during crimping, when the first barrel piece portion 15 and the second barrel piece portion 16 are brought into contact with each other for the first time, it is preferable to prevent the end surfaces of the distal ends 15*a* and 16*a* from coming into contact with each other. This is because such contact between the end surfaces may cause unnecessary deformation of the first barrel piece portion 15 or the second barrel piece portion 16, or may cause the second barrel piece portion 16 to enter between the first barrel piece portion 15 and the electric wire 50, so that there is a possibility that desired crimping cannot be performed.

Figure 18:
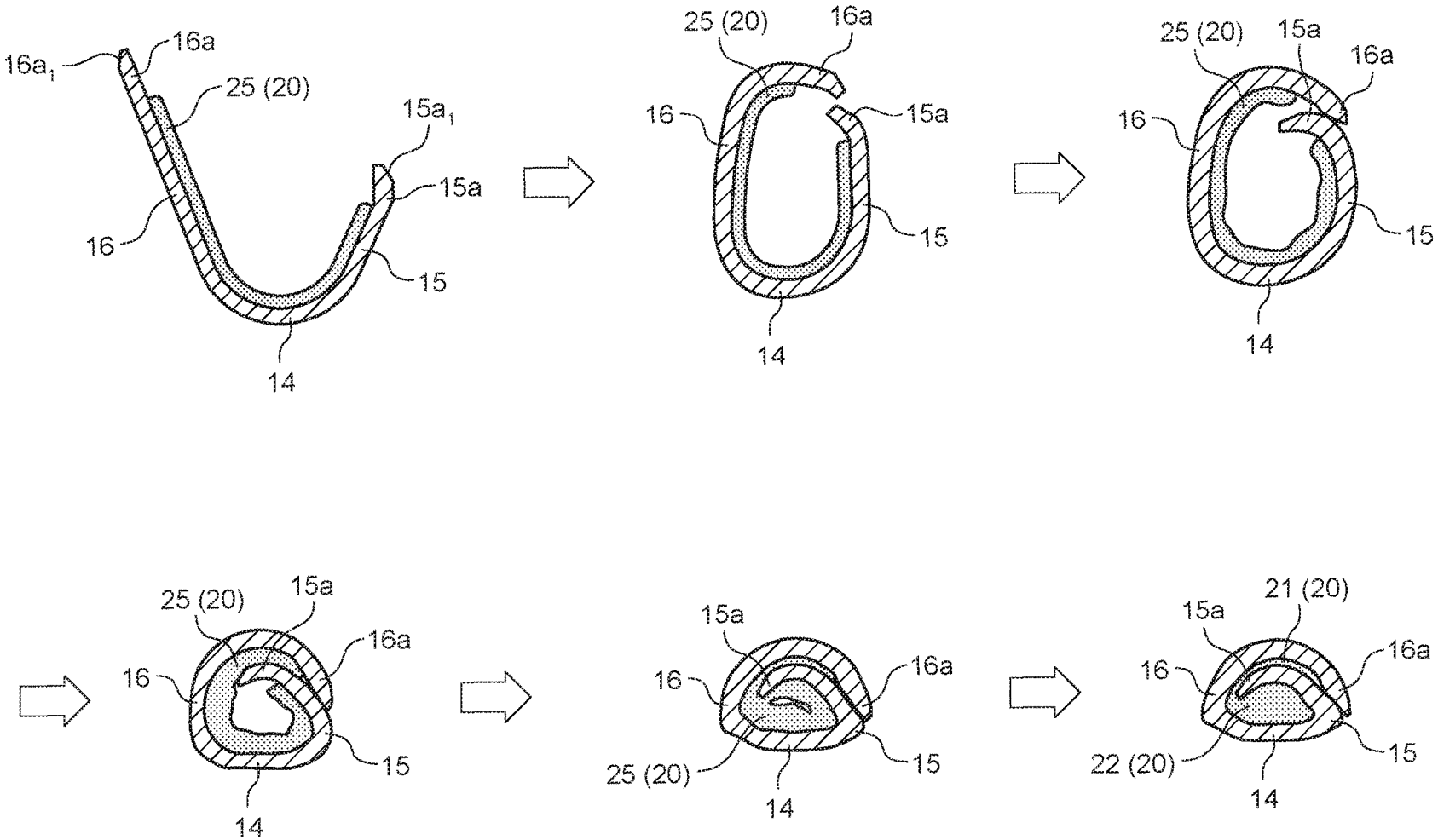
FIG. 18 is a diagram illustrating crimping processes at a sectional portion taken along line Y1-Y1 in FIG. 4.
Figure 19:
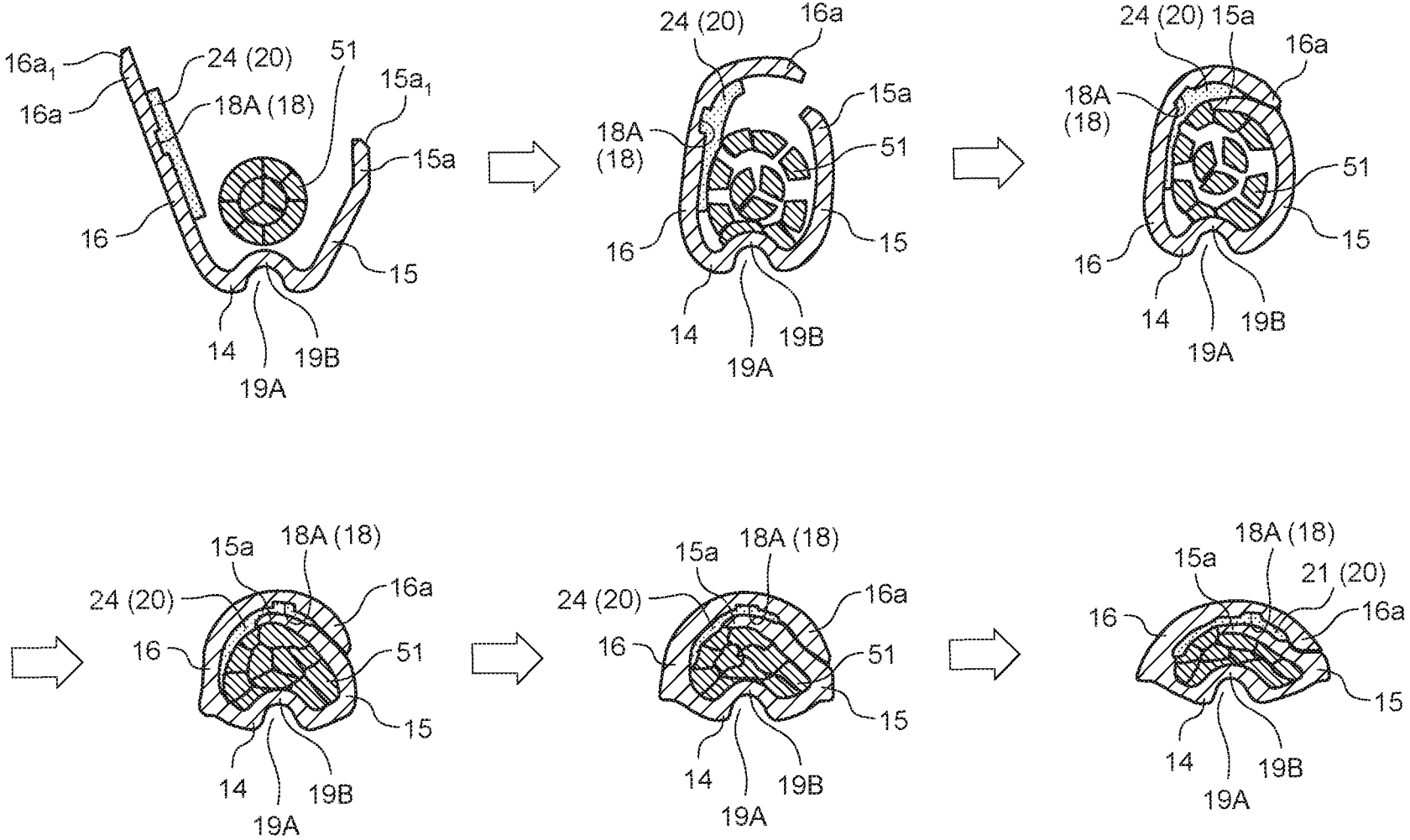
FIG. 19 is a diagram illustrating crimping processes at a sectional portion taken along line Y2-Y2 in FIG. 4.
Figure 20:
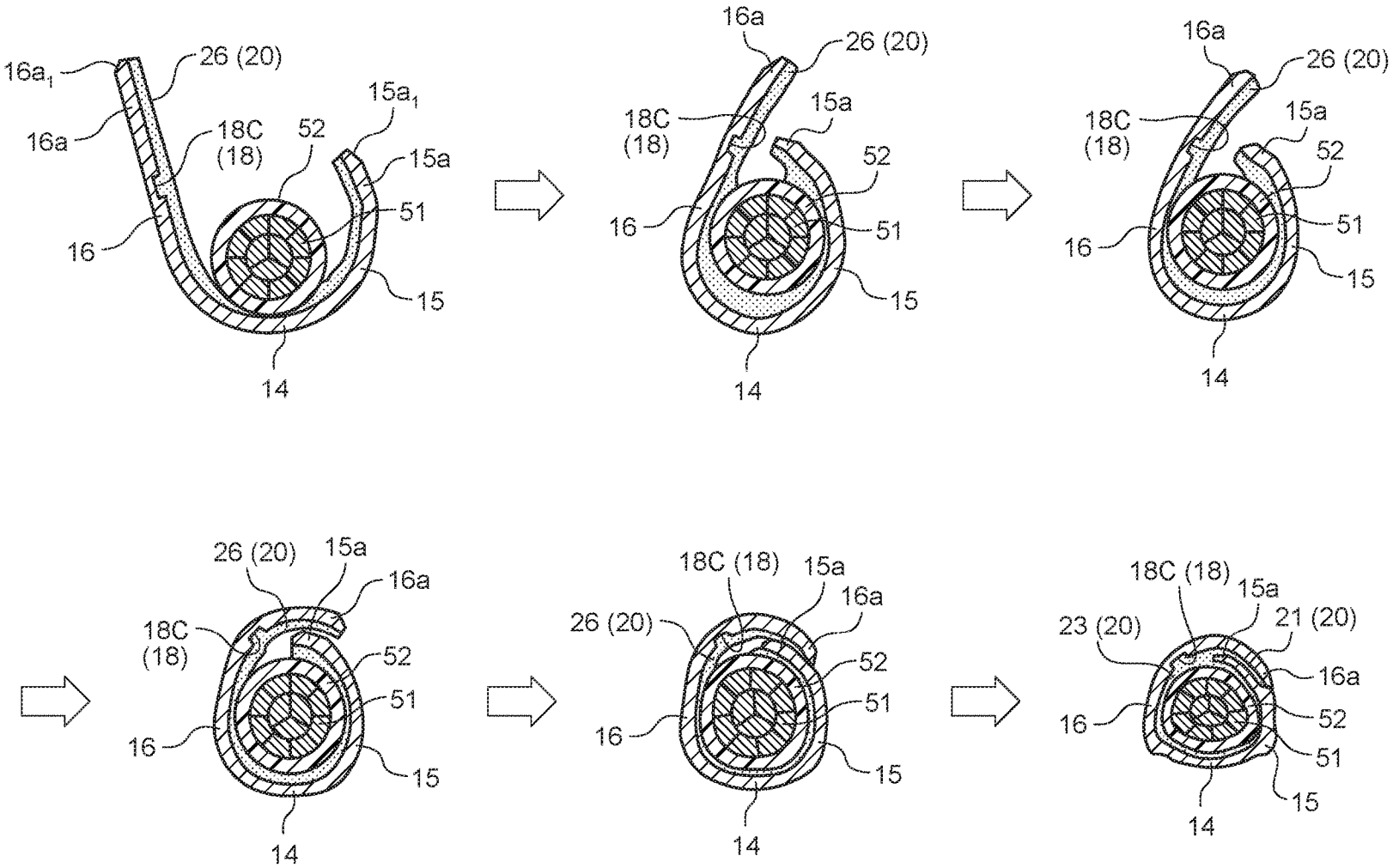
FIG. 20 is a diagram illustrating crimping processes at a sectional portion taken along line Y3-Y3 in FIG. 4.

In view of this, in the crimp terminal 1 of the present embodiment, the distal end 15*a* of the first barrel piece portion 15 in the U-shaped electric wire connecting portion 12 is bent toward the second barrel piece portion 16 (FIG. 7), whereby a clearance is provided between the distal end 15*a* and a sliding-contact surface (specifically, the upright surface 115$b_1$ in the infolding portion 115*b* of the first wall surface 115) with the first barrel piece portion 15 in the descending second die 113 (the first crimper 113A and the second crimper 113B). In the crimp terminal 1 of the present embodiment, by forming the distal end 15*a* of the first barrel piece portion 15 in this manner, the possibility of contact between the end surfaces of the distal ends 15*a* and 16*a* in the crimping process can be reduced, and the second barrel piece portion 16 can be caused to enter between the first barrel piece portion 15 and the first wall surface 115 (FIG. 18 to FIG. 20). FIG. 18 is a diagram illustrating crimping processes at a sectional portion (in an area on the terminal connecting portion 11 side with respect to the distal end position of the distal-end core wire 51) taken along line Y1-Y1 in FIG. 4. FIG. 19 is a diagram illustrating crimping processes at a sectional portion (portion crimped on the distal-end core wire 51) taken along line Y2-Y2 in FIG. 4. FIG. 20 is a diagram illustrating crimping processes at a sectional portion (portion crimped on the coating 52) taken along line Y3-Y3 in FIG. 4. In FIG. 18 to FIG. 20, for convenience of illustration, the first and the second dies 112 and 113 are omitted.

In the crimp terminal 1, the above-described shape of the distal end 15*a* of the first barrel piece portion 15 can suppress, for example, unnecessary deformation of the first barrel piece portion 15 and the second barrel piece portion 16 and position misalignment of the electric wire connecting portion 12 due to contact between the end surfaces of the distal ends 15*a* and 16*a*. Thus, desired crimping can be performed, and the waterproof performance with the water stop member 20 can be improved. Herein, in the crimp terminal 1, so as to be able to cover the outer wall surface of the distal end 15*a* of the first barrel piece portion 15 after crimp completion with the water stop member 20 on the inner wall surface of the second barrel piece portion 16, it is preferable to set an area on the inner wall surface of the second barrel piece portion 16 on which water stop member 20 is pasted. By this setting, in the crimp terminal 1, the first water stop area 21 can be formed also between the outer wall surface of the distal end 15*a* and the inner wall surface of the second barrel piece portion 16, and thus the waterproof performance therebetween can be improved. On the terminal connecting portion 11 side with respect to the distal end position of the distal-end core wire 51, the distal end 15*a* is covered by the water stop member 20 both on the inner wall surface side and the outer wall surface side, and thus the waterproof performance in the second water stop area 22 can be improved.

Specifically, the distal end 15*a* of the first barrel piece portion 15 is bent such that the clearance between the sliding-contact surface and the distal end 15*a* is greater than at least the plate thickness of the distal end 16*a* of the second barrel piece portion 16. When the water stop member 20 is pasted upon the distal end 16*a* of the second barrel piece portion 16, the distal end 15*a* of the first barrel piece portion 15 is bent such that the clearance between the sliding-contact surface and the distal end 15*a* is greater than at least the sum of the plate thickness of the distal end 16*a* of the second barrel piece portion 16 and the plate thickness of the water stop member 20. For example, in the present embodiment, the distal end 15*a* is bent toward the second barrel piece portion 16 such that the clearance between the distal end 15*a* and the upright surface 115$b_1$ is greater than at least the plate thickness of the distal end 16*a* of the second barrel piece portion 16 (the sum of the plate thickness of the distal end 16*a* and the plate thickness of the water stop member 20 when the water stop member 20 is pasted upon the distal end 16*a*) at the time when the first barrel piece portion 15 has reached the upright surface 115$b_1$ during descending of the second die 113. In other words, the distal end 15*a* is bent toward the second barrel piece portion 16 such that the clearance between an imaginary plane containing the outer wall surface of a main part of the first barrel piece portion 15 and the end surface of the distal end 15*a* is greater than at least the plate thickness of the distal end 16*a* of the second barrel piece portion 16 (the sum of the plate thickness of the distal end 16*a* and the plate thickness of the water stop member 20 when the water stop member 20 is pasted upon the distal end 16*a*). By this bending, in the crimp terminal 1, contact between the end surfaces of the distal ends 15*a* and 16*a* in the crimping process can be suppressed, and the second barrel piece portion 16 can be caused to enter between the first barrel piece portion 15 and the first wall surface 115.

The shape of the bent distal end 15*a* (mainly the bent angle and the bending start position of the distal end 15*a* (i.e., the length of the bent portion)) is preferably determined so that the end portion of the electric wire 50 can be inserted between the first barrel piece portion 15 and the second barrel piece portion 16 during crimping, and the distal end 15*a* can be prevented from coming into contact with the end portion of the electric wire 50 during this insertion. By this shape determination, in the crimp terminal 1 of the present embodiment, a situation in which crimping is inhibited by the bent distal end 15*a* can be avoided. The bent shape of the distal end 15*a* may be different between in the core wire crimp portion 12A and in the coating crimp portion 12B. For example, the bent shape of the distal end 15*a* in the coating crimp portion 12B is preferably formed such that a distal end surface in the distal end 15*a* does not come into contact with the coating 52. By this formation, in the crimp terminal 1, tear or other damages of the coating 52 caused by the distal end 15*a* can be suppressed.

Furthermore, on the distal ends 15*a* and 16*a* on each outer wall surface side, it is preferable to form tapered surfaces 15$a_1$ and 16$a_1$ such that the plate thicknesses of the distal ends 15*a* and 16*a* decrease from the bottom portion 14 side toward the end surfaces of the distal ends 15*a* and 16*a* (FIG. 18 to FIG. 20). The tapered surfaces 15$a_1$ and 16$a_1$ may be formed in the pressing process of the electric wire connecting portion 12. In the crimp terminal 1 of the present embodiment, by the distal ends 15*a* and 16*a* thus tapered, the clearance between the distal end 15*a* and the first wall surface 115 can be increased, and the distal end 16*a* to be inserted therebetween on the end surface side can be made thinner. Thus, contact between the end surfaces of the distal ends 15*a* and 16*a* in the crimping process can be suppressed, and the second barrel piece portion 16 can be easily inserted into between the first barrel piece portion 15 and the first wall surface 115. Consequently, with the crimp terminal 1, desired crimping can be performed, and the waterproof performance with the water stop member 20 can be improved.

No matter how bending or other processing is performed on the distal end 15*a*, if the attitude of the electric wire connecting portion 12 during crimping is not kept suitable for the first and the second dies 112 and 113, the end surface of the distal end 16*a* of the second barrel piece portion 16 may come into contact with the end surface of the distal end 15*a*, or the distal end 16*a* may enter between the first barrel piece portion 15 and the electric wire 50. The suitable attitude herein means a state in which the bottom portion 14 in the electric wire connecting portion 12 is arranged at the lowermost end and is placed on the recessed surfaces 112$A_1$ and 112$B_1$, and the opening between the first barrel piece portion 15 and the second barrel piece portion 16 faces the first and the second crimpers 113A and 113B. For example, in the crimp terminal 1, the arc-shaped bottom portion 14 in the electric wire connecting portion 12 is placed on the arc-shaped recessed surfaces 112$A_1$ and 112$B_1$, and also the first barrel piece portion 15 and the second barrel piece portion 16 are different in length. Thus, depending on how force is applied from the first crimper 113A to the first barrel piece portion 15 or how force is applied from the second crimper 113B to the second barrel piece portion 16, the electric wire connecting portion 12 may rotate along the circumferential direction of the recessed surfaces 112$A_1$ and 112$B_1$. In view of this, in the present embodiment, at least one of a plurality of measures described below is preferably taken to suppress the rotation of the electric wire connecting portion 12 during crimping.

For example, in order to suppress the rotation of the electric wire connecting portion 12, at least one of the terminal connecting portion 11, the connecting band 31, and the joint portion 32 that are arranged on both ends of the electric wire connecting portion 12 only needs to be held during crimping.

Figure 21:
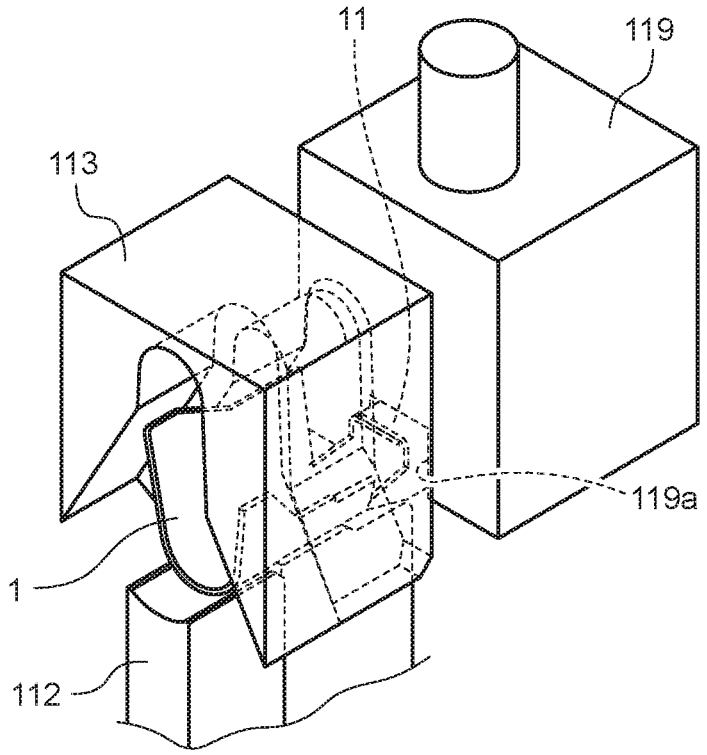
FIG. 21 is a diagram for explaining a state in which the terminal connecting portion is held by an anti-rotation structure.

In order to hold the terminal connecting portion 11, the terminal crimping device 100 may be provided with an anti-rotation body 119 that suppresses the rotation of the terminal connecting portion 11 of the crimp terminal 1 placed in the crimp position (FIG. 21). The anti-rotation body 119 of this example is configured to hold the terminal connecting portion 11 from both sides in the second direction W, and has a rectangular-parallelepiped space (holding portion) 119*a* into which the terminal connecting portion 11 is inserted. The anti-rotation body 119 is fixed to the ram 114A, for example, and is vertically moved integrally with the second die 113. The anti-rotation body 119 descends together with the second die 113, whereby the terminal connecting portion 11 is inserted into the holding portion 119*a*. The timing of inserting the terminal connecting portion 11 into the holding portion 119*a* is set to be a time before the first crimper 113A or the second crimper 113B comes into contact with the first barrel piece portion 15 or the second barrel piece portion 16. By this setting, the terminal crimping device 100 of the present embodiment can suppress the rotation of the terminal connecting portion 11 even before the crimping is actually started, and can keep the attitude of the electric wire connecting portion 12 suitable during crimping. Thus, the terminal crimping device 100 can prevent contact between the end surfaces of the distal ends 15*a* and 16*a* in the crimping process, and can cause the second barrel piece portion 16 to enter between the first barrel piece portion 15 and the first wall surface 115, so that unnecessary deformation, for example, of the first barrel piece portion 15 and the second barrel piece portion 16 can be suppressed, and desired crimping can be performed.

Figure 22:
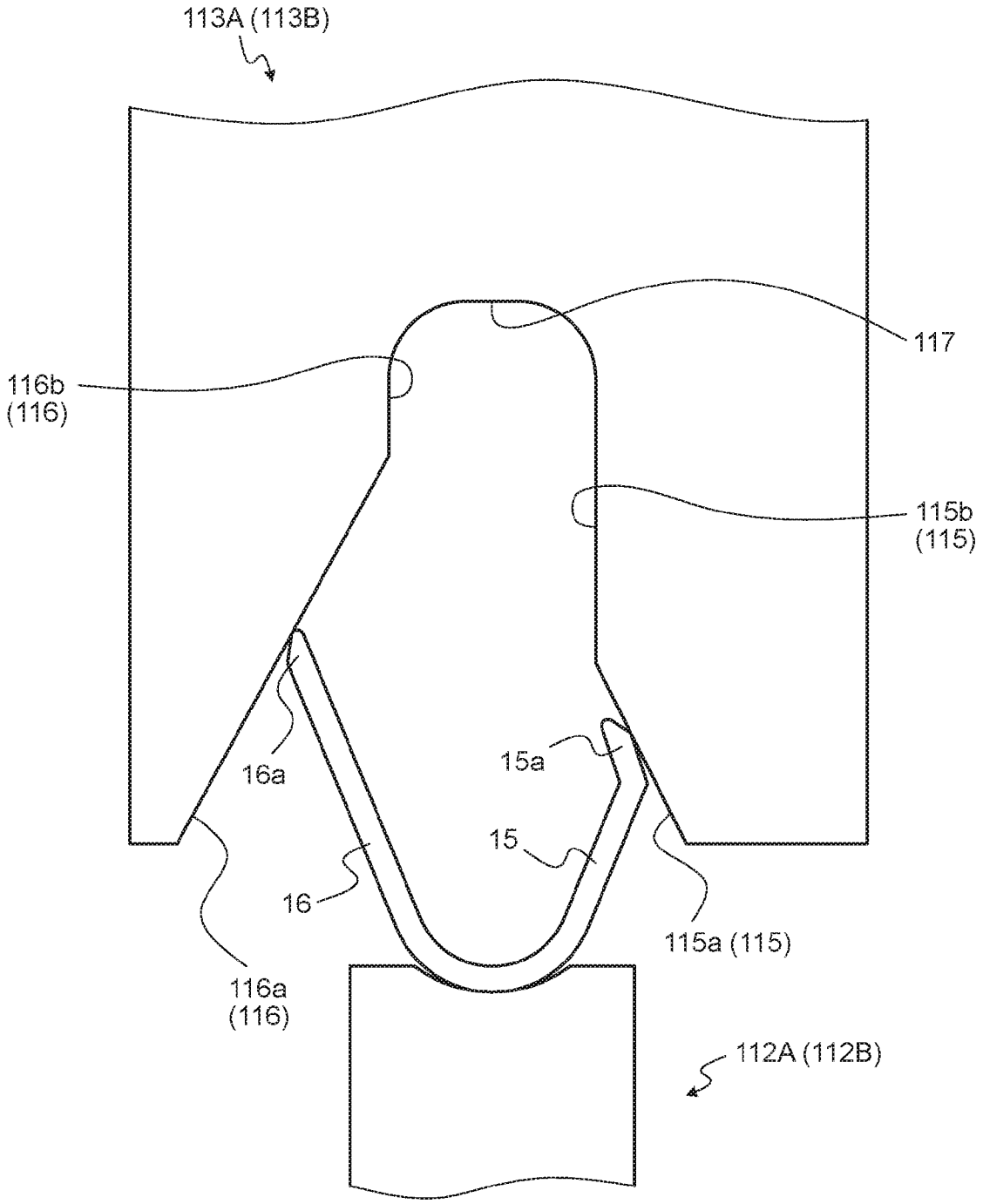
FIG. 22 is a diagram for explaining a structure of suppressing rotation of the electric wire connecting portion with the second die (crimper)

Herein, even when the terminal connecting portion 11 or the connecting band 31 is held, if there is a lag between the timing when force is applied from the second die 113 to the first barrel piece portion 15 (i.e., the timing when the second die 113 comes into contact with the first barrel piece portion 15) and the timing when force is applied from the second die 113 to the second barrel piece portion 16 (i.e., the timing when the second die 113 comes into contact with the second barrel piece portion 16), the electric wire connecting portion 12 may rotate while the terminal connecting portion 11, for example, is being held. In view of this, the second die 113 is formed so that, when descending, the first wall surface 115 and the second wall surface 116 can be substantially simultaneously brought into contact with the first barrel piece portion 15 and the second barrel piece portion 16, respectively (FIG. 22). When crimping is performed in the order from the core wire crimp portion 12A toward the coating crimp portion 12B, the first crimper 113A comes into contact with the electric wire connecting portion 12 earlier than the second crimper 113B does. Accordingly, the first wall surface 115 and the second wall surface 116 of the first crimper 113A are formed so as to be substantially simultaneously brought into contact with the first barrel piece portion 15 and the second barrel piece portion 16, respectively. When crimping is performed in the order from the coating crimp portion 12B toward the core wire crimp portion 12A, the second crimper 113B comes into contact with the electric wire connecting portion 12 earlier than the first crimper 113A does. Accordingly, the first wall surface 115 and the second wall surface 116 of the second crimper 113B are formed so as to be substantially simultaneously brought into contact with the first barrel piece portion 15 and the second barrel piece portion 16, respectively. When crimping is performed from the coupling crimp portion 12C toward the core wire crimp portion 12A and also toward the coating crimp portion 12B, either one of the first crimper 113A and the second crimper 113B comes into contact with the first barrel piece portion 15 or the second barrel piece portion 16 in the coupling crimp portion 12C first. Accordingly, the first wall surface 115 and the second wall surface 116 of the one that comes into contact first are formed so as to be substantially simultaneously brought into contact with the first barrel piece portion 15 and the second barrel piece portion 16, respectively.

The shapes of the receiving portions 115*a* and 116*a* are set so that the first wall surface 115 and the second wall surface 116 of the corresponding first crimper 113A or second crimper 113B can substantially simultaneously come into contact with the first barrel piece portion 15 and the second barrel piece portion 16, respectively. For example, when the absolute values of the inclined angles of the receiving portions 115*a* and 116*a* are the same, the first wall surface 115 and the second wall surface 116 are formed such that the boundary between the receiving portion 116*a* and the infolding portion 116*b* is arranged higher than the boundary between the receiving portion 115*a* and the infolding portion 115*b* is. By this formation, when descending, the receiving portions 115*a* and 116*a* substantially simultaneously come into contact with the first barrel piece portion 15 and the second barrel piece portion 16, thereby being able to substantially simultaneously and substantially evenly apply force to the first barrel piece portion 15 and the second barrel piece portion 16, respectively. Thus, even if the second die 113 continues to descend without interruption, the electric wire connecting portion 12 can be suppressed from rotating until the crimping is completed. Thus, the terminal crimping device 100 of the present embodiment can keep the attitude of the electric wire connecting portion 12 suitable during crimping. Consequently, the terminal crimping device 100 can prevent contact between the end surfaces of the distal ends 15*a* and 16*a* in the crimping process, and can cause the second barrel piece portion 16 to enter between the first barrel piece portion 15 and the first wall surface 115, so that desired crimping can be more appropriately performed.

In the terminal crimping device 100 of the present embodiment, rotation of the electric wire connecting portion 12 during crimping may be suppressed by the first die 112. For example, on the bottom portion 14 of the electric wire connecting portion 12 of this example, a depression 19A that is depressed from the outer wall surface side toward the inner wall surface in a pressing process is formed (e.g., FIG. 7 and FIG. 11). On the distal end of the first die 112, in a position facing the depression 19A, a projection 112*b* that protrudes toward the depression 19A is formed (FIG. 16). The projection 112*b* may be formed on either one or both of the recessed surfaces 112$A_1$ and 112$B_1$ of the first anvil 112A and the second anvil 112B. The respective shapes of the depression 19A and the projection 112*b* are set so that, for example, the projection 112*b* can be fitted into the depression 19A. By this setting, the projection 112*b* is fitted into the depression 19A, whereby the relative movement of the crimp terminal 1 supplied to the crimp position with respect to the first die 112 is restricted, and the suitable attitude of the electric wire connecting portion 12 can be kept during crimping. Furthermore, the depression 19A and the projection 112*b* have a function of positioning the supplied crimp terminal 1 in the crimp position. Thus, the crimp terminal 1 and the terminal crimping device 100 of the present embodiment can prevent contact between the end surfaces of the distal ends 15*a* and 16*a* in the crimping process, and can cause the second barrel piece portion 16 to enter between the first barrel piece portion 15 and the first wall surface 115, so that desired crimping can be performed.

Herein, on the inner wall surface of the electric wire connecting portion 12, a projection 19B is formed during pressing of the depression 19A. When the depression 19A and the projection 19B are formed on the bottom portion 14 in the core wire crimp portion 12A, by maintaining the projection 19B until and even after the crimping, the contact area of the distal-end core wire 51 to the electric wire connecting portion 12 is increased, and the close contact strength between the distal-end core wire 51 and the electric wire connecting portion 12 is also increased, so that electrical connection therebetween can be enhanced. In view of this, in the present embodiment, the depression 19A and the projection 19B are formed on the bottom portion 14 at least in the core wire crimp portion 12A, and the projection 112*b* that is inserted into the depression 19A during crimping is formed on the recessed surface 112$A_1$ of the first anvil 112A. In this example, also in the coupling crimp portion 12C, the depression 19A and the projection 19B are formed. The depression 19A, the projection 19B, and the projection 112*b* extend in the longitudinal direction (first direction L) of the distal-end core wire 51. The respective shapes of the depression 19A, the projection 19B, and the projection 112*b* are set such that the projection 19B protrudes from the inner wall surface of the bottom portion 14 even if the distal-end core wire 51 crushes the projection 19B in crimping. By this setting, in the crimp terminal 1 and the terminal crimping device 100 of the present embodiment, by the remaining projection 19B, the contact area of the distal-end core wire 51 to the electric wire connecting portion 12 can be increased, and the close contact strength between the distal-end core wire 51 and the electric wire connecting portion 12 is increased, so that electrical connection therebetween can be enhanced. Furthermore, in the crimp terminal 1 and the terminal crimping device 100 of the present embodiment, by inserting the projection 112*b* into the depression 19A in the crimping process, the projection 19B can be left remaining at the same time as the crimping process. Thus, the crimp terminal 1 and the terminal crimping device 100 can obtain the close contact strength between the electric wire connecting portion 12 and the core wire 51 while increasing productivity. Furthermore, the depression 19A and the projection 19B of this example are formed in the serration area 17. Thus, because the close contact strength between the distal-end core wire 51 and the electric wire connecting portion 12 is further increased by the remaining projection 19B and the serration area 17, the distal-end core wire 51 can be electrically connected to the electric wire connecting portion 12 more reliably.

The projection 112*b* may be formed larger in size than the inner space of the depression 19A so as to be able to press out the projection 19B toward the core wire 51 by engaging into the depression 19A during crimping. In other words, the depression 19A may be formed smaller in size than the inner space of the projection 112*b* so that the projection 112*b* engages thereinto during crimping and accordingly the projection 19B can be pressed out toward the core wire 51. For example, the height of the projection 112*b* from the recessed surface 112$A_1$ is set greater than the depth of the depression 19A from the outer wall surface of the electric wire connecting portion 12. By making the projection 112*b* larger than the depression 19A in this manner, in the crimp terminal 1, the projection 19B is enlarged toward the electric wire 50 with the projection 112*b* of the first anvil 112A engaging into the depression 19A as crimping proceeds, and this enlargement generates adhesive wear between the projection 19B and the distal-end core wire 51. Thus, with the depression 19A, the projection 19B, and the projection 112*b*, the crimp terminal 1 and the terminal crimping device 100 can further increase the contact area of the distal-end core wire 51 to the electric wire connecting portion 12, whereby the close contact strength between the distal-end core wire 51 and the electric wire connecting portion 12 is further increased, so that electrical connection therebetween can be further enhanced.

As described above, in the crimp terminal 1 and the terminal crimping device 100 of the present embodiment, with the depression 19A, the projection 19B, and the projection 112*b*, not only positioning and the attitude can be maintained, but also electrical connection between the distal-end core wire 51 and the electric wire connecting portion 12 after crimping can be enhanced. Furthermore, in the crimp terminal 1 and the terminal crimping device 100, when aluminum is used for the core wire 51, oxide film on the surface of the core wire 51 can be removed by the adhesion wear generated at the projection 19B, so that electrical connection between the distal-end core wire 51 and the electric wire connecting portion 12 in this structure can be enhanced. Herein, the depression 19A and the projection 19B may be one depression and one projection as in the present embodiment, or may include a plurality of depressions and a plurality of projections. In this latter case, the projection 112*b* is formed so as to have protrusions the number and the positions of which correspond to those of depressions of the depression 19A.

Figure 23:
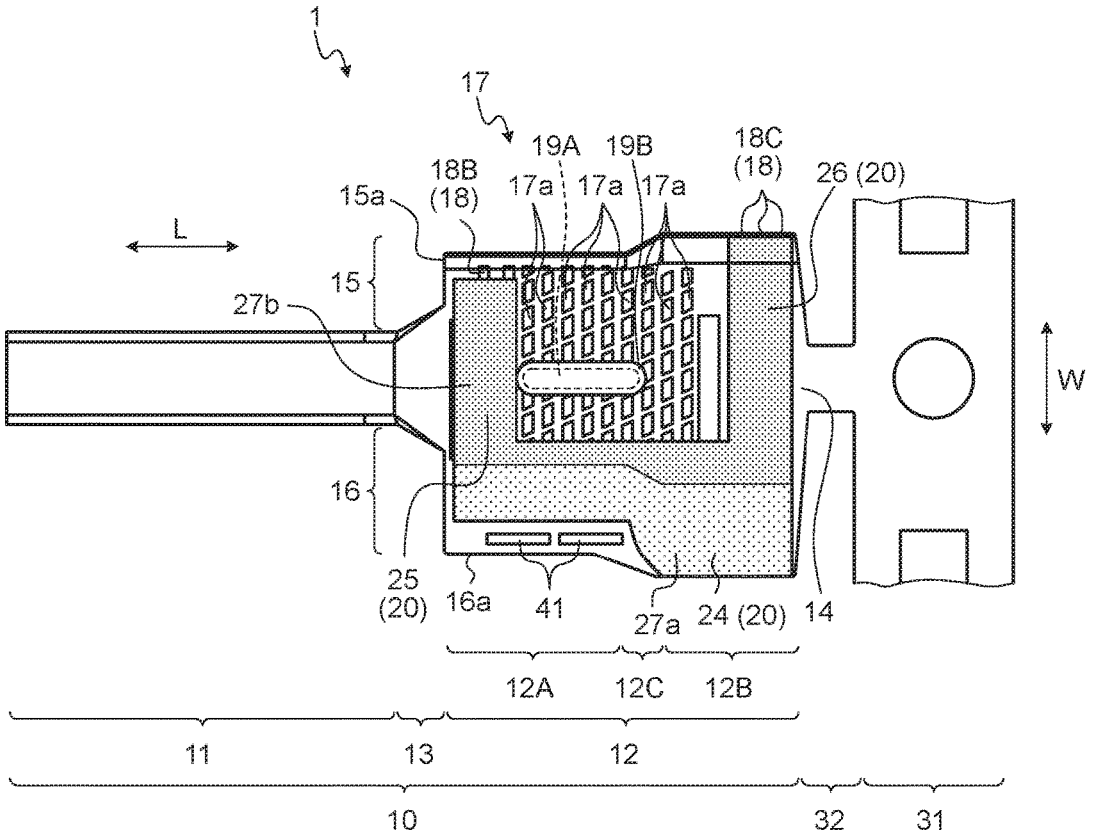
FIG. 23 is a diagram for explaining a sliding range and a remaining range in the water stop member.
Figure 24:
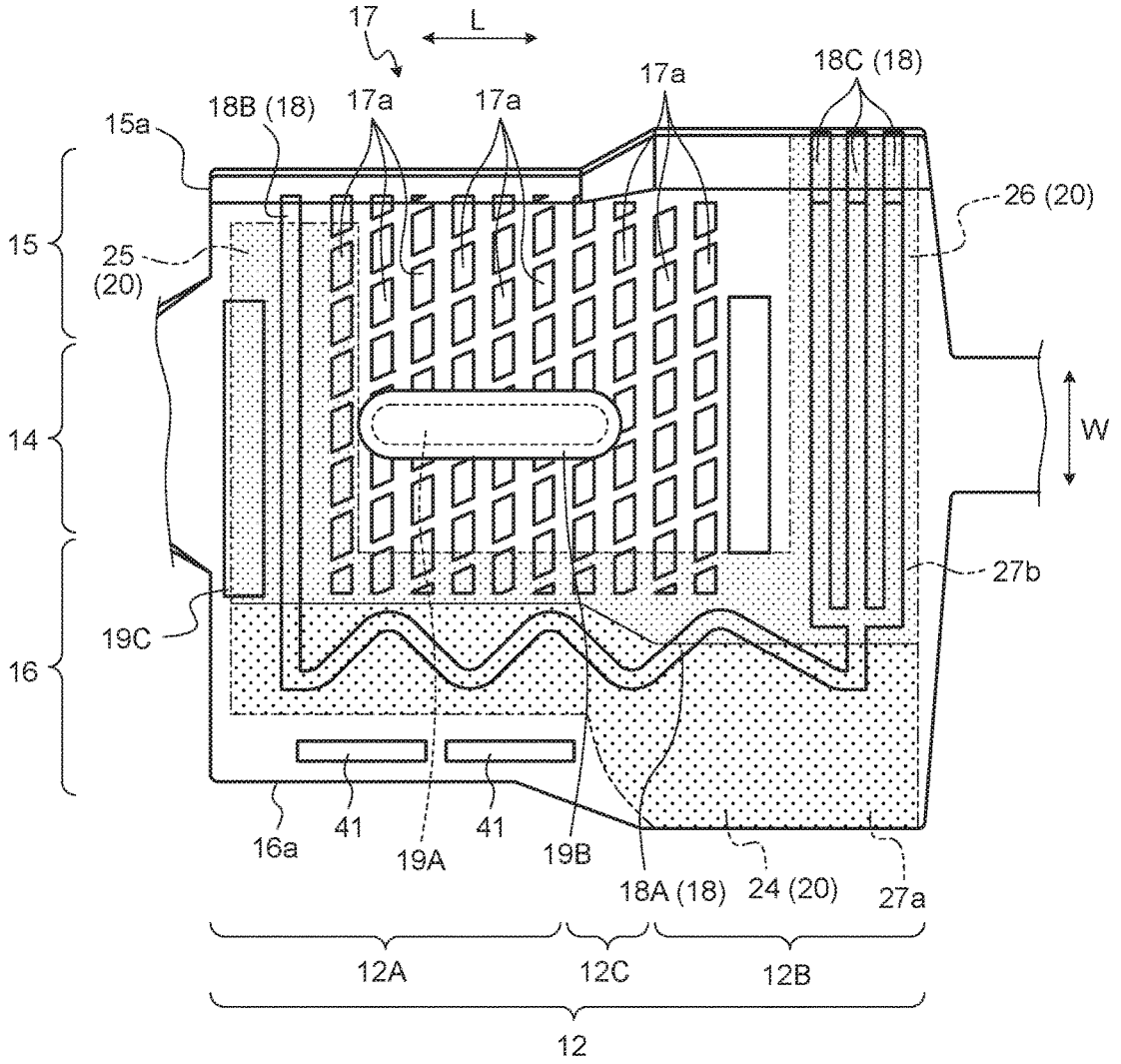
FIG. 24 is a diagram illustrating one example of an accommodating groove according to the embodiment.

After the distal end 16*a* of the second barrel piece portion 16 enters between the first barrel piece portion 15 and the first wall surface 115, the first barrel piece portion 15 and the second barrel piece portion 16 are swaged while sliding on each other between the outer wall surface side of the first barrel piece portion 15 and the inner wall surface side of the second barrel piece portion 16. Thus, the water stop member 20 on the second barrel piece portion 16 side may be scraped off by the first barrel piece portion 15 in a predetermined range from the distal end 16*a* side to the bottom portion 14 side. This predetermined range is a sliding range 27*a* (FIG. 23 and FIG. 24) between the first barrel piece portion 15 and the water stop member 20, and corresponds to the above-described overlap area. If the water stop member 20 is scraped off, the first to the third water stop areas 21, 22, and 23 in a connected state are not formed appropriately, which may deteriorate the waterproof performance. The hatched areas in FIG. 23 and FIG. 24 are areas representing for convenience the sliding range 27*a* against the first barrel piece portion 15 in the water stop member 20 and a remaining range 27*b* in which sliding against the first barrel piece portion 15 does not occur in the water stop member 20.

Herein, the first water stop portion 24 of the water stop member 20 extends up to the bottom portion 14 side with respect to the overlap area (the sliding range 27*a*) as described above (FIG. 23 and FIG. 24). Thus, in the crimp terminal 1, after crimp completion, the first water stop area 21 and the second and the third water stop areas 22 and 23 are formed in a manner connected to each other by the first water stop portion 24, and the second and the third water stop portions 25 and 26, respectively, at least on the bottom portion 14 side with respect to the sliding range 27*a*. In other words, after crimp completion, the water stop member 20 is charged into an area at least on the inner side with respect to the overlap area in the electric wire connecting portion 12. Thus, even if the water stop member 20 of the sliding range 27*a* is scraped off, the crimp terminal 1 can suppress water entry between the electric wire connecting portion 12 and the distal-end core wire 51.

In the crimp terminal 1 of the present embodiment, as described above, bending is performed on the distal end 15*a* of the first barrel piece portion 15. Thus, the crimp terminal 1 can suppress peeling of the water stop member 20 caused by, for example, an edge of the end surface of the distal end 15*a*. Furthermore, in the crimp terminal 1 of the present embodiment, this bending allows the sliding range 27*a* to be narrowed. In other words, in the crimp terminal 1 of the present embodiment, this bending allows the first to the third water stop areas 21, 22, and 23 in a connected state to be easily formed. Thus, in the crimp terminal 1, the bending of the distal end 15*a* enables the waterproof performance to be improved.

In the crimping process, the water stop member 20 forms the first to the third water stop areas 21, 22, and 23 while being moved slidingly against the first barrel piece portion 15 and against the end portion of the electric wire 50 and deforming. In the crimp terminal 1, because the deforming movement of the water stop member 20 is not always constant, the first to the third water stop areas 21, 22, and 23 are not always formed uniformly. From this aspect, the crimp terminal 1 has room for improving the waterproof performance.

In the present embodiment, the first to the third water stop areas 21, 22, and 23 are configured so as to be formed appropriately even if position misalignment, for example, of the water stop member 20 due to deformation during crimping occurs. For this configuration, in the present embodiment, on an area on which the water stop member 20 is pasted in the inner wall surface of the electric wire connecting portion 12, a groove (hereinafter, called "accommodating groove") 18 into which part of the pasted water stop member 20 is charged is formed (FIG. 24), and the water stop member 20 is caused to remain inside and near this accommodating groove 18 even after the crimping. In order to charge part of the water stop member 20 into the accommodating groove 18, pressure is applied to the water stop member 20 toward the electric wire connecting portion 12 when the water stop member 20 is pasted on the electric wire connecting portion 12. In the present embodiment, a pressure that is sufficient to be able to push part of the water stop member 20 into the accommodating groove 18 is set, and the groove width of the accommodating groove 18 is set to a dimension that allows the part of the water stop member 20 to enter the groove. By this setting, the water stop member 20 can be caused to remain at least inside the accommodating groove 18 even after the crimping.

The accommodating groove 18 is a groove that is formed along the shape of the water stop member 20, and has: a first groove portion 18A that is formed along the extending direction (first direction L) of the first water stop portion 24 in an area on which the first water stop portion 24 is pasted; a second groove portion 18B that is formed along the extending direction (second direction W) of the second water stop portion 25 in an area on which the second water stop portion 25 is pasted; and a third groove portion 18C that is formed along the extending direction (second direction W) of the third water stop portion 26 in an area on which the third water stop portion 26 is pasted. The first water stop area 21 is formed by the water stop member 20 remaining at least inside the first groove portion 18A. The second water stop area 22 is formed by the water stop member 20 remaining at least inside the second groove portion 18B. The third water stop area 23 is formed by the water stop member 20 remaining at least inside the third groove portion 18C.

The first groove portion 18A is formed in the overlap area (area corresponding to the sliding range 27*a*) on the inner wall surface of the second barrel piece portion 16. Specifically, on the inner wall surface of the second barrel piece portion 16, within an area (the sliding range 27*a*) that is slidable against the outer wall surface of the first barrel piece portion 15 during crimping, in an area (overlap area) that overlaps the outer wall surface of the first barrel piece portion 15 after completion of the crimping, the first groove portion 18A is formed. Into this first groove portion, part of the water stop member 20 (the first water stop portion 24) on the inner wall surface of the second barrel piece portion 16 is charged that wears but remains therein after being scraped off by the outer wall surface of the first barrel piece portion 15 during the crimping. By this formation, in the crimp terminal 1, even if the first water stop portion 24 in the sliding range 27*a* is scraped off by the first barrel piece portion 15, part of the first water stop portion 24 can be caused to remain inside the first groove portion 18A within the sliding range 27*a*. In this example, also part of the second groove portion 18B and part of the third groove portion 18C are formed in the overlap area (area corresponding to the sliding range 27*a*). In other words, the first groove portion 18A extends between the second water stop area 22 and the third water stop area 23 formed by the water stop member 20. Thus, in the crimp terminal 1, even if the first water stop portion 24 in the sliding range 27*a* is scraped off by the first barrel piece portion 15, part of the first water stop portion 24 remains also in the part of the second groove portion 18B and the part of the third groove portion 18C. In the overlap area, part of the water stop member 20 remaining inside the accommodating groove 18 forms a water stop area that extends between the terminal connecting portion 11 side with respect to the distal end position of the distal-end core wire 51 and the coating 52 side. In the overlap area, this water stop area can suppress water entry between the electric wire connecting portion 12 and the distal-end core wire 51 from between the outer wall surface of the first barrel piece portion 15 and the inner wall surface of the second barrel piece portion 16 after crimp completion. The water stop area formed by the accommodating groove 18 in the overlap area is, at its both ends, connected continuously to a water stop area formed by the remaining range 27*b* of the water stop member 20 and thus, together with the water stop area of the remaining range 27*b*, forms the first water stop area 21.

Herein, in the crimp terminal 1 after crimp completion, a space therein on the terminal connecting portion 11 side with respect to the distal end position of the distal-end core wire 51 is sealed with the second water stop area 22, and a space between the electric wire connecting portion 12 and the coating 52 is sealed with the third water stop area 23, whereby the waterproof performance is kept in both sides. In view of this, the accommodating groove 18 in the overlap area only needs to be formed on at least an area, in the inner wall surface of the second barrel piece portion 16, that is wound around the distal-end core wire 51. By this structure also, in the crimp terminal 1 after crimp completion, the waterproof performance between the electric wire connecting portion 12 and the distal-end core wire 51 can be improved.

The second groove portion 18B extends between the distal end 15*a* side of the first barrel piece portion 15 and the distal end 16*a* side of the second barrel piece portion 16, on the terminal connecting portion 11 side with respect to the distal end position of the distal-end core wire 51 in the inner wall surface of the core wire crimp portion 12A, on the terminal connecting portion 11 side with respect to the serration area 17. In this example, the second groove portion 18B is formed straight along the extending direction thereof. Part of the second water stop portion 25 charged into the second groove portion 18B serves as a component of the second water stop area 22, and can suppress water entry between the electric wire connecting portion 12 and the distal-end core wire 51 from the terminal connecting portion 11 side with respect to the distal end position of the distal-end core wire 51.

In the accommodating groove 18, the first groove portion 18A preferably communicates with the second groove portion 18B. This communication between the first groove portion 18A and the second groove portion 18B connects the first water stop area 21 and the second water stop area 22 continuously to each other, and can suppress generation of a gap between the first water stop area 21 and the second water stop area 22, and thus the waterproof performance can be improved. Herein, the second groove portion 18B forms part of the second water stop area 22 mainly with the second water stop portion 25, and also forms part of the first water stop area 21 with the first water stop portion 24.

Figure 25:
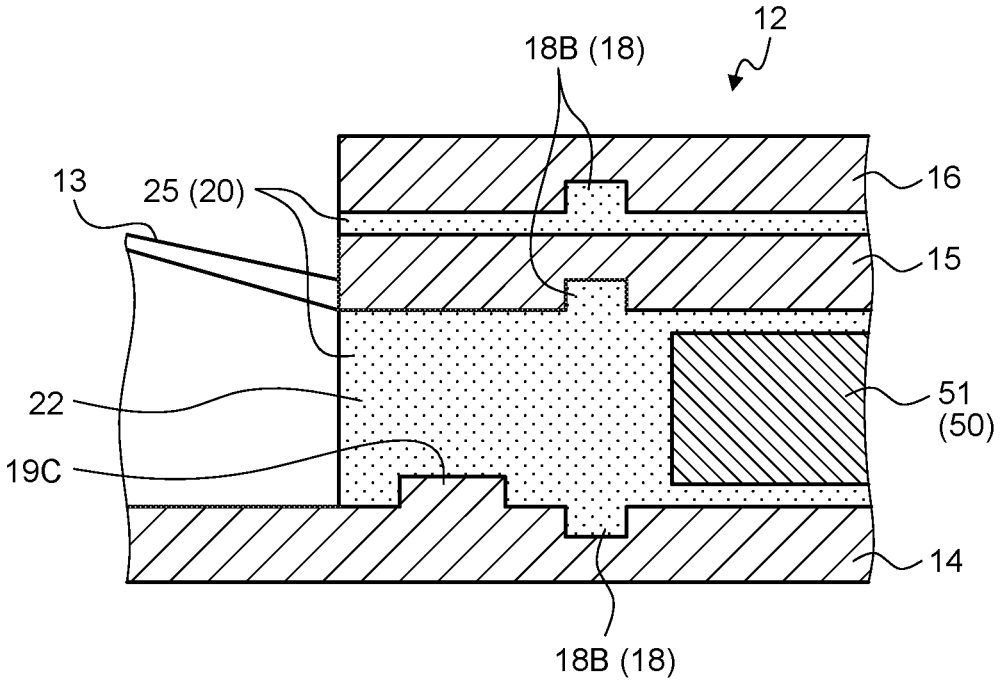
FIG. 25 is a sectional view illustrating the terminal connecting portion side in the electric wire connecting portion after crimping is completed.

Herein, on the electric wire connecting portion 12, a protruding portion 19C protruding from the inner wall surface is formed on the terminal connecting portion 11 side with respect to the distal end position of the distal-end core wire 51 and the serration area 17 (FIG. 11 and FIG. 25, etc.). The protruding portion 19C is formed in a rectangular-parallelepiped shape, and is arranged along the second direction W. As described above, the first barrel piece portion 15 and the second barrel piece portion 16 have the overlap area in which the outer wall surface of either one of these barrel piece portions and the inner wall surface of the other overlap each other. Thus, if the protruding portion 19C is formed in this overlap area, when crimping is completed, a gap due to the protruding portion 19C may be formed between the first barrel piece portion 15 and the second barrel piece portion 16, and this gap may deteriorate the waterproof performance. In view of this, the protruding portion 19C is preferably arranged in a position apart from the overlap area, for example.

The protruding portion 19C is configured to increase the stiffness of the electric wire connecting portion 12. The protruding portion 19C also increases the waterproof performance by locking the electric wire 50 (the distal end position of the core wire 51) stretching in the axial direction during crimping. The protruding portion 19C suppresses the locked electric wire 50 (the distal end position of the core wire 51) from further stretching, thereby suppressing the second water stop portion 25 pushed by the distal end position of the stretching core wire 51 from being squeezed out from the electric wire connecting portion 12. Consequently, in the crimp terminal 1 of the present embodiment, the protruding portion 19C can suppress defective deformation of the second water stop area 22 formed by the second water stop portion 25, and thus the waterproof performance in this position can be improved.

In the electric wire connecting portion 12 of this example, the water stop member 20 (the second water stop portion 25) is pasted on the top surface of the protruding portion 19C in an overlapping manner (FIG. 13). Specifically, the second water stop portion 25 is pasted on an area at least between the top surface of the protruding portion 19C and the second groove portion 18B. The second water stop portion 25 pasted on the area therebetween and the second water stop portion 25 charged into the second groove portion 18B serve as a component of the second water stop area 22 after crimping is completed. In the crimp terminal 1 of the present embodiment, because the second water stop portion 25 overlaps the top surface of the protruding portion 19C, the water stop member 20 is easily compressed by the protruding portion 19C in the crimping process compared to the case without the protruding portion 19C. Thus, the charging efficiency of the second water stop portion 25 in the second water stop area 22 is increased, and the waterproof performance with the second water stop area 22 can be improved. On the other hand, this overlapping on the protruding portion 19C may cause part of the water stop member 20 near the protruding portion 19C to rise from the inner wall surface of the plate-shaped electric wire connecting portion 12, whereby the pasted position may be misaligned. However, in the crimp terminal 1 of the present embodiment, on the inner wall surface thereof, the accommodating groove 18 (the first groove portion 18A, the second groove portion 18B, and the third groove portion 18C) is formed, and part of the water stop member 20 can be put into the accommodating groove 18 when the water stop member 20 is pasted. Thus, even if the pasted position of the water stop member 20 overlaps the position of the protruding portion 19C, the position misalignment of the water stop member 20 can be suppressed. In the crimp terminal 1, the second groove portion 18B is arranged between the serration area 17 and the protruding portion 19C (i.e., between the distal end position of the distal-end core wire 51 and the protruding portion 19C), and thus the rising area of the water stop member 20 can be reduced. From this viewpoint also, the charging efficiency of the second water stop portion 25 in the second water stop area 22 can be increased.

The third groove portion 18C extends between the distal end 15*a* side of the first barrel piece portion 15 and the distal end 16*a* side of the second barrel piece portion 16, on the inner wall surface of the coating crimp portion 12B. In this example, the third groove portion 18C is formed straight along the extending direction thereof. Part of the third water stop portion 26 charged into the third groove portion 18C forms an annular water stop area between the inner wall surface of the coating crimp portion 12B and the coating 52. In the crimp terminal 1, this water stop area thereof can suppress water entry from therebetween into between the electric wire connecting portion 12 and the distal-end core wire 51. This water stop area, together with an annular water stop area formed between the inner wall surface of the coating crimp portion 12B and the coating 52 by the surrounding third water stop portion 26, forms the third water stop area 23.

In the accommodating groove 18, the first groove portion 18A preferably communicates with the third groove portion 18C. This communication between the first groove portion 18A and the third groove portion 18C connects the first water stop area 21 and the third water stop area 23 continuously to each other, and can suppress generation of a gap between the first water stop area 21 and the third water stop area 23, and thus the waterproof performance can be improved. Herein, the water stop member 20 in the third groove portion 18C forms the third water stop area 23 mainly with the third water stop portion 26, and also forms part of the first water stop area 21 with the first water stop portion 24.

The third groove portion 18C is preferably formed in plurality. By this formation in plurality, in the crimp terminal 1, even if a deviation in peeled-off length of the coating 52 has caused misalignment of the position on which the coating 52 is placed, at least one third groove portion 18C among them can form the third water stop area 23 in an annular space between the electric wire connecting portion 12 and the coating 52. In this example, three third groove portions 18C are formed in a manner spaced from each other. These three third groove portions 18C are integrated into one on the distal end 16*a* side. This integrated area is coupled to the first groove portion 18A.

In the crimp terminal 1 of the present embodiment, as described above, the first groove portion 18A, the second groove portion 18B, and the third groove portion 18C can improve the waterproof performance in the respective corresponding portions, and can suppress water entry between the electric wire connecting portion 12 and the distal-end core wire 51. Thus, the crimp terminal 1 can improve its durability, and also can improve the durability of the electric wire 50. Particularly when the terminal fitting 10 and the core wire 51 are formed of different types of metallic materials as described above, this crimp terminal 1 has a water-entry suppressing effect so as to be able to suppress electrolytic corrosion from occurring therebetween. Furthermore, the first groove portion 18A of this example is connected continuously to each of the second groove portion 18B and the third groove portion 18C. In other words, the accommodating groove 18 of this example is formed so as to surround the serration area 17 in a U-shape (FIG. 24). Thus, in the crimp terminal 1 of the present embodiment, the first water stop area 21 can be connected continuously to each of the second water stop area 22 and the third water stop area 23 to eliminate a gap between the respective water stop areas, and thus the waterproof performance can be further improved, and water entry between the electric wire connecting portion 12 and the distal-end core wire 51 can be further suppressed. Consequently, in this case, durability of the crimp terminal 1 and the electric wire 50 can be further improved.

In the crimp terminal according to the present embodiments, the protruding portion suppresses the distal end position of the locked core wire from further stretching, thereby suppressing the water stop member pushed by the distal end position of the stretching core wire from being squeezed out from the electric wire connecting portion. Consequently, in the crimp terminal according to the present invention, this protruding portion can suppress defective formation of the water stop area formed by the water stop member, and thus the waterproof performance in this position can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp terminal comprising:

a terminal fitting having a terminal connecting portion that is electrically connected to a counterpart terminal and an electric wire connecting portion that is electrically connected to a core wire of an electric wire by crimping to an end portion of the electric wire placed on an inner wall surface of the electric wire connecting portion; and a water stop member that is pasted on the inner wall surface of the electric wire connecting portion before the crimping is performed and that, after the crimping is completed, forms a water stop area that is capable of suppressing water entry between the electric wire connecting portion and the core wire from the terminal connecting portion side with respect to a distal end position of a core wire at a distal end of the electric wire, wherein the electric wire connecting portion has a core wire crimp portion that is crimped on the core wire at the distal end of the electric wire by winding each of first and second barrel piece portions around the end portion of the electric wire during the crimping, the inner wall surface of the core wire crimp portion has, on the terminal connecting portion side with respect to the distal end position of the core wire placed, a protruding portion configured to lock the distal end position of the core wire that stretches in an axial direction during the crimping, and the protruding portion is formed in a regular-parallelepiped shape and arranged along a width direction of the crimp terminal on the inner wall surface.

2. The crimp terminal according to claim 1, wherein the water stop member is pasted on a top surface of the protruding portion, the inner wall surface of the core wire crimp portion has a groove portion into which part of the water stop member pasted is charged between the distal end position of the core wire and the protruding portion, and the water stop member between the top surface of the protruding portion and the groove portion and the water stop member charged into the groove portion serve as a component of the water stop area after the crimping is completed.

3. The crimp terminal according to claim 1, wherein the first barrel piece portion and the second barrel piece portion have an overlap area in which an outer wall surface of either one of these barrel piece portions and the inner wall surface of the other of these barrel piece portions overlap each other, and the protruding portion is arranged in a position apart from the overlap area.

4. The crimp terminal according to claim 2, wherein the first barrel piece portion and the second barrel piece portion have an overlap area in which an outer wall surface of either one of these barrel piece portions and the inner wall surface of the other of these barrel piece portions overlap each other, and the protruding portion is arranged in a position apart from the overlap area.

5. A crimp terminal comprising:

a terminal fitting having a terminal connecting portion that is electrically connected to a counterpart terminal and an electric wire connecting portion that is electrically connected to a core wire of an electric wire by crimping to an end portion of the electric wire placed on an inner wall surface of the electric wire connecting portion; and a water stop member that is pasted on the inner wall surface of the electric wire connecting portion before the crimping is performed and that, after the crimping is completed, forms a water stop area that is capable of suppressing water entry between the electric wire connecting portion and the core wire from the terminal connecting portion side with respect to a distal end position of a core wire at a distal end of the electric wire, wherein the electric wire connecting portion has a core wire crimp portion that is crimped on the core wire at the distal end of the electric wire by winding each of first and second barrel piece portions around the end portion of the electric wire during the crimping, the inner wall surface of the core wire crimp portion has, on the terminal connecting portion side with respect to the distal end position of the core wire placed, a protruding portion configured to lock the distal end position of the core wire that stretches in an axial direction during the crimping, the water stop member is pasted on a top surface of the protruding portion, the inner wall surface of the core wire crimp portion has a groove portion into which part of the water stop member pasted is charged, the groove portion is arranged between the distal end position of the core wire and the protruding portion, and the water stop member between the top surface of the protruding portion and the groove portion and the water stop member charged into the groove portion serve as a component of the water stop area after the crimping is completed.

* * * * *